US009016269B2

(12) United States Patent
Kasashima et al.

(10) Patent No.: US 9,016,269 B2
(45) Date of Patent: Apr. 28, 2015

(54) CEMENTED CARBIDE BASE OUTER BLADE CUTTING WHEEL AND MAKING METHOD

(75) Inventors: Masaki Kasashima, Echizen (JP); Takehisa Minowa, Echizen (JP); Harukazu Maegawa, Echizen (JP); Yoshifumi Nagasaki, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 491 days.

(21) Appl. No.: 13/541,263

(22) Filed: Jul. 3, 2012

(65) Prior Publication Data

US 2013/0008422 A1 Jan. 10, 2013

(30) Foreign Application Priority Data

Jul. 4, 2011 (JP) ..... 2011-148045

(51) Int. Cl.
*B24D 18/00* (2006.01)
*B24D 3/06* (2006.01)
*B24D 5/12* (2006.01)

(52) U.S. Cl.
CPC ... *B24D 3/06* (2013.01); *B24D 5/12* (2013.01)

(58) Field of Classification Search
USPC ..... 125/15; 51/298, 308
See application file for complete search history.

(56) References Cited

U.S. PATENT DOCUMENTS

| | | | | |
|---|---|---|---|---|
| 6,012,977 | A * | 1/2000 | Yoshikawa et al. | 451/541 |
| 6,098,609 | A * | 8/2000 | Ishizuka | 125/13.01 |
| 6,517,427 | B1 * | 2/2003 | Yoshikawa et al. | 451/547 |
| 7,350,518 | B2 * | 4/2008 | Cogswell | 125/15 |
| 2004/0079033 | A1 * | 4/2004 | Long | 51/297 |
| 2007/0023026 | A1 * | 2/2007 | Michelle | 125/15 |
| 2007/0151554 | A1 * | 7/2007 | Song et al. | 125/15 |
| 2008/0178536 | A1 * | 7/2008 | Johnson | 51/298 |
| 2008/0187769 | A1 | 8/2008 | Huzinec et al. | |
| 2009/0165768 | A1 * | 7/2009 | Kasashima et al. | 125/15 |
| 2010/0275522 | A1 * | 11/2010 | Kasashima et al. | 51/295 |

FOREIGN PATENT DOCUMENTS

JP 2010-179438 A 8/2010

* cited by examiner

*Primary Examiner* — Lee D Wilson
*Assistant Examiner* — Henry Hong
(74) *Attorney, Agent, or Firm* — Westerman, Hattori, Daniels & Adrian, LLP

(57) ABSTRACT

An outer blade cutting wheel comprising an annular thin disc base of cemented carbide and a blade section of metal or alloy-bonded abrasive grains on the outer periphery of the base is provided. The abrasive grains are diamond and/or cBN grains having an average grain size of 45-310 μm and a TI of at least 150. The blade section includes overlays having a thickness tolerance ($T3_{max}$–$T3_{min}$) of 0.001 mm to 0.1×T2 mm. The blade section has a roundness ($OD_{max}/2$–$OD_{min}/2$) of 0.001 mm to 0.01×$OD_{max}$ mm.

6 Claims, 6 Drawing Sheets

CEMENTED CARBIDE BASE OUTER BLADE CUTTING WHEEL AND MAKING METHOD

CROSS-REFERENCE TO RELATED APPLICATION

This non-provisional application claims priority under 35 U.S.C. §119(a) on Patent Application No. 2011-148045 filed in Japan on Jul. 4, 2011, the entire contents of which are hereby incorporated by reference.

TECHNICAL FIELD

This invention relates to a cemented carbide base outer-diameter blade cutting wheel suited for sawing rare earth sintered magnet blocks, and a method for preparing the same.

BACKGROUND ART

Known in the art are OD (outer diameter) blade cutting wheels comprising a cemented carbide base having an outer periphery to which diamond and/or cBN abrasive grains are bonded with phenolic resins or metal plating. The sawing process using such cutting wheels is regarded very useful in the industry because of many advantages including the low price of the cutting tool, a relatively small cutting allowance, a good dimensional accuracy of cut pieces, and a relatively high machining speed. Since the cutting wheels are best suited for sawing of rare earth sintered magnet blocks (or permanent magnet blocks) which are hard and brittle, they are widely used in the art.

CITATION LIST

Patent Document 1: JP-A H09-174441
Patent Document 2: JP-A H10-175171
Patent Document 3: JP-A H10-175172
Patent Document 4: JP-A 2005-193358
Patent Document 5: JP-A H07-207254
Patent Document 6: JP 2942989
Patent Document 7: JP-A 2005-219169
Patent Document 8: WO 96/23630
Patent Document 9: JP-A 2009-172751 (US 20090165768, EP 2075092)
Patent Document 10: JP-A 2010-260124 (US 20100275522, EP 2260963)

DISCLOSURE OF INVENTION

The inventors proposed in Patent Documents 9 and 10 an outer blade cutting wheel comprising an annular disc base and a blade section disposed on the outer periphery of the base and comprising magnetic material-coated diamond and/or cBN abrasive grains which are bound to the base by electroplating or electroless plating, the wheel being capable of cutting a magnet block into pieces at a high accuracy and a reduced dimensional tolerance, and a method for manufacturing the same.

This OD blade cutting wheel is suited for high accuracy cutting operation partly because the blade section having diamond and/or cBN abrasive grains bound to the base by a phenolic resin has a high rigidity. It was found that if a choice of abrasive grains is less compatible with a dimensional tolerance selected for the blade section, the blade section must be dressed to reshape the cutting edge thereof, in order to maintain the dimensional tolerance of cut pieces or rare earth sintered magnet pieces at a high accuracy.

At the time when the blade section ceases to maintain a high accuracy of cutting operation, it is observed that abrasive grains shed off, abrasive grains are fractured to form cavities below the surface of the grain-retaining matrix (bond), and/or abrasive grains are flattened at their tip to become coextensive to the surface of the grain-retaining matrix. It is believed that shedding and fracture of abrasive grains are caused by impacts upon cutting because abrasive grains heavily collide against a workpiece to abrade off the workpiece. Flattening of abrasive grains at their tip to become coextensive to the surface of the grain-retaining matrix is caused by not only impacts upon cutting, but also local generation of high heat whereby grains are worn or consumed. This phenomenon holds true for abrasive grains of diamond when the workpiece is a rare earth sintered magnet containing a metal element which is highly reactive at high temperature. The heat generated during working causes chemical reaction to occur between the metal element in the workpiece and grains (diamond), and as a result, grains are worn or consumed.

During cutting operation, a coolant is generally fed to a site being cut for the purpose of cooling the site. Thus it is not believed hitherto that the cutting heat has a substantial impact on the wear of abrasive grains, especially diamond grains.

For the overlay portion of the blade section that protrudes beyond the base in a thickness direction, when the thickness of the overlay portion has a substantial dimensional tolerance, that is, a substantial difference between maximum and minimum of the thickness of the overlay portion throughout the circumference of the blade section, and when the outer circumference of the blade section has a low roundness, chips cut out of the workpiece are not smoothly discharged and clog in the cutting groove to alter the path of the wheel, to cause vibration to the workpiece with loud impact noise, and to provide a discontinuous or insufficient supply of coolant to the cutting site, leading to cutting deficiency. If such a phenomenon occurs, the size of cut pieces becomes inaccurate, or the cut surfaces bear noticeable scratch marks. Because of these appearance defects, the product yield is reduced.

If the blade section becomes defective or blunt, the dressing step of abrading away the grain-retaining matrix with a grinding tool until new grains are exposed is necessary so that they may contribute to cutting operation. However, dressing of the blade section of the OD blade cutting wheel reduces the production efficiency because the cutting process is interrupted. Also scraping of the blade section reduces the lifetime of the cutting wheel. Thus it is preferred to refrain from dressing if possible.

An object of the invention is to provide a cemented carbide base outer-diameter blade cutting wheel which can be used over a long term without a need for dressing and suited for cutting a workpiece, typically rare earth sintered magnet block into pieces at a high dimensional accuracy, and a method for preparing the same.

The invention relates to an outer blade cutting wheel comprising a base in the form of an annular thin disc and a blade section on the outer periphery of the base, the blade section comprising abrasive grains and a metal or alloy bond, the metal or alloy bond being deposited on the outer periphery of the base by electroplating or electroless plating for bonding abrasive grains together and to the base. The inventors have found that better results are obtained when diamond and/or cBN abrasive grains having an average grain size of 45 to 310 μm and a toughness index TI of at least 150 are used as the abrasive grains, and the blade section is formed so as to meet specific geometry and topography conditions. Even when abrasive grains having heat resistance and impact resistance and a toughness index TI of at least 150 are used, the outer blade cutting wheel continues cutting operation over a long term while maintaining a high cutting accuracy because of the minimized risk of abrasive grains being fractured, shed or thermally consumed during the cutting operation where the outer blade cutting wheel is exposed to severe impacts.

In one aspect, the invention provides an outer blade cutting wheel comprising a base in the form of an annular thin disc of cemented carbide having a Young's modulus of 450 to 700 GPa, having an outer diameter of 80 to 200 mm defining an outer periphery, an inner diameter of 30 to 80 mm, and a thickness of 0.1 to 1.0 mm, and a blade section disposed on the outer periphery of the base and having a greater thickness than the base, the blade section comprising abrasive grains and a metal or alloy bond, the metal or alloy bond being deposited on the outer periphery of the base by electroplating or electroless plating for bonding abrasive grains together and to the base. The abrasive grains are diamond and/or cBN abrasive grains having an average grain size of 45 to 310 μm and a toughness index TI of at least 150. The blade section includes overlay portions which each protrude outward beyond the thickness of the base, the thickness of the overlay portion of the blade section meets a tolerance [($T3_{max}$−$T3_{min}$) mm] in the range (1):

$$00.001 \leq T3_{max} - T3_{min} \leq 0.1 \times T2_{max} \quad (1)$$

wherein $T3_{max}$ and $T3_{min}$ are maximum and minimum values of the thickness of the overlay portion throughout the circumference of the blade section, $T2_{max}$ is a maximum value of the thickness of the blade section throughout the circumference of the blade section. The blade section meets a roundness [($OD_{max}/2-OD_{min}/2$) mm] in the range (2):

$$0.001 \leq OD_{max}/2 - OD_{min}/2 \leq 0.01 \times OD_{max} \quad (2)$$

wherein $OD_{max}$ and $OD_{min}$ are maximum and minimum values of the outer diameter of the blade section.

In a preferred embodiment, the blade section further comprises a metal or alloy binder having a melting point of up to 350° C. After the metal or alloy bond is deposited on the outer periphery of the base by plating for bonding abrasive grains together and to the base, the metal or alloy binder is infiltrated between abrasive grains and between abrasive grains and the base.

In another preferred embodiment, the blade section further comprises a thermoplastic resin having a melting point of up to 350° C. or a thermosetting resin having a curing temperature of up to 350° C. After the metal or alloy bond is deposited on the outer periphery of the base by plating for bonding abrasive grains together and to the base, the thermoplastic resin is infiltrated between abrasive grains and between abrasive grains and the base, or a liquid thermosetting resin composition is infiltrated and cured between abrasive grains and between abrasive grains and the base.

In another aspect, the invention provides a method for manufacturing an outer blade cutting wheel comprising the steps of providing a base in the form of an annular thin disc of cemented carbide having a Young's modulus of 450 to 700 GPa, having an outer diameter of 80 to 200 mm defining an outer periphery, an inner diameter of 30 to 80 mm, and a thickness of 0.1 to 1.0 mm; providing abrasive grains; and electroplating or electroless plating a metal or alloy on the base outer periphery for bonding the abrasive grains together and to the base to fixedly secure the abrasive grains to the base outer periphery to form a blade section having a greater thickness than the base. The method further comprises the steps of using diamond and/or cBN abrasive grains having an average grain size of 45 to 310 μm and a toughness index TI of at least 150 as the abrasive grains; and shaping the blade section such that the blade section includes overlay portions which each protrude outward beyond the thickness of the base, the thickness of the overlay portion of the blade section has a tolerance [($T3_{max}$−$T3_{min}$) mm] in the range (1):

$$0.001 \leq T3_{max} - T3_{min} < 0.1 \times T2_{max} \quad (1)$$

wherein $T3_{max}$ and $T3_{min}$ are maximum and minimum values of the thickness of the overlay portion throughout the circumference of the blade section, $T2_{max}$, is a maximum value of the thickness of the blade section throughout the circumference of the blade section, and the blade section has a roundness [($OD_{max}/2-OD_{min}/2$) mm] in the range (2):

$$0.001 \leq OD_{max}/2 - OD_{min}/2 \leq 0.01 \times OD_{max} \quad (2)$$

wherein $OD_{max}$ and $OD_{min}$ are maximum and minimum values of the outer diameter of the blade section.

The method may further comprise, after the step of plating a metal or alloy on the outer periphery of the base for bonding abrasive grains together and to the base, the step of letting a metal or alloy binder having a melting point of up to 350° C. infiltrate into any voids between abrasive grains and between abrasive grains and the base to form the blade section.

Also the method may further comprise, after the step of plating a metal or alloy on the outer periphery of the base for bonding abrasive grains together and to the base, the step of letting a thermoplastic resin having a melting point of up to 350° C. infiltrate into any voids between abrasive grains and between abrasive grains and the base to form the blade section, or a liquid thermosetting resin composition having a curing temperature of up to 350° C. infiltrate and cure into any voids between abrasive grains and between abrasive grains and the base to form the blade section.

ADVANTAGEOUS EFFECTS OF INVENTION

Using the cemented carbide base outer-diameter blade cutting wheel, an article, typically rare earth sintered magnet block can be cut into pieces at a high dimensional accuracy. Since the cutting wheel can be used over a long term without a need for dressing, in cutting of an article into pieces of high accuracy dimensions, the extra steps which are otherwise required to maintain high-accuracy cutting operation can be substantially saved. In extreme cases, the step of inspecting the dimensions of cut pieces may be simplified. Rare earth magnet pieces having a high dimensional accuracy are obtained at a low cost.

DESCRIPTION OF THE PREFERRED EMBODIMENT

Figure 1A:
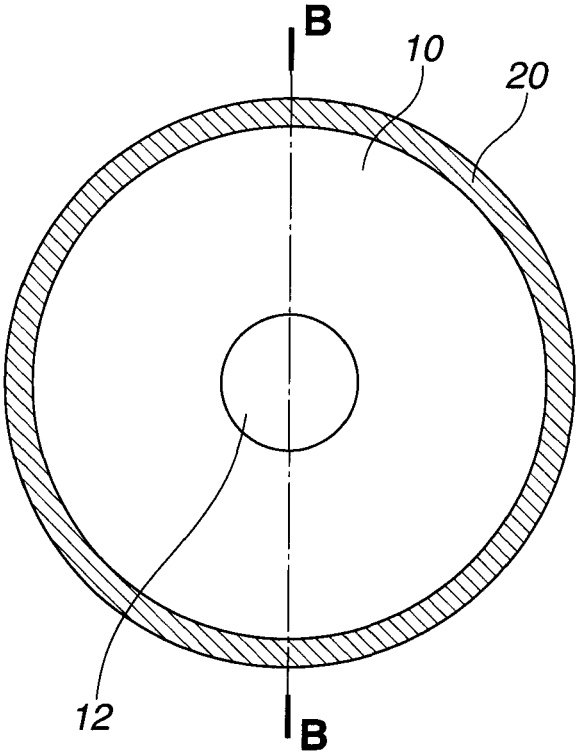
FIG. 1 schematically illustrates an outer blade cutting wheel in one embodiment of the invention, FIG. 1A being a plan view, FIG. 1B being a cross-sectional view taken along lines B-B in FIG. 1A, and FIG. 1C being an enlarged view of circle C (blade section) in FIG. 1B.
Figure 1B:
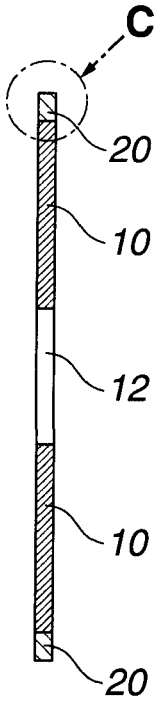

Referring to FIG. 1, the outer blade cutting wheel in one embodiment of the invention is illustrated as comprising a base 10 in the form of an annular thin disc made of cemented carbide and a blade section 20 disposed on the outer periphery of the base 10. The blade section 20 comprises abrasive grains bonded with a metal or metal alloy bond by electroplating or electroless plating.

The base 10 is in the form of an annular thin disc, that is, a doughnut-shaped thin plate having a center bore 12, having an outer diameter of 80 to 200 mm, preferably 100 to 180 mm, defining an outer periphery, an inner diameter of 30 to 80 mm, preferably 40 to 70 mm, defining the bore 12, and a thickness of 0.1 to 1.0 mm, preferably 0.2 to 0.8 mm.

It is noted that the disc has a center bore and an outer circumference as shown in FIG. 1. Thus, the terms "radial" and "axial" are used relative to the center of the disc, and so, the thickness is an axial dimension, and the length (or height) is a radial dimension. Likewise the terms "inside" and "outside" are sometimes used relative to the center of the disc or the rotating shaft of the cutting wheel.

The base has a thickness in the range of 0.1 to 1.0 mm and an outer diameter in the range of not more than 200 mm because a base of such dimensions can be manufactured at a high accuracy and ensures consistent cut-off machining of a workpiece, typically a rare earth sintered magnet block at a high dimensional accuracy over a long term. A thickness of less than 0.1 mm leads to a likelihood of noticeable warpage independent of outer diameter and makes difficult the manufacture of a base at a high accuracy. A thickness in excess of 1.0 mm indicates an increased cutting allowance. The outer diameter is up to 200 mm in view of the size that can be manufactured by the existing technology of producing and processing cemented carbide. The diameter of the bore is set in a range of 30 to 80 mm so as to fit on the shaft of the cutoff machining tool.

Examples of the cemented carbide of which the base is made include those in which powder carbides of metals in Groups 4, 5, and 6 of the Periodic Table such as WC, TiC, MoC, NbC, TaC and $Cr_3C_2$ are cemented in a binder matrix of Fe, Co, Ni, Mo, Cu, Pb, Sn or a metal alloy thereof, by sintering. Among these, typical WC—Co, WC—Ti, C—Co, and WC—TiC—TaC—Co systems are preferred. They should have a Young's modulus of 450 to 700 GPa. Also, those cemented carbides which have an electric conductivity susceptible to plating or which can be given such an electric conductivity with palladium catalysts or the like are preferred. For provision of cemented carbides with an electric conductivity by palladium catalysts or the like, well-known agents such as metallizing agents used in the metallization of ABS resins may be employed.

The outer periphery of the base may advantageously be chamfered (beveled or rounded) in order to enhance the bond strength between the base and the blade section which is formed thereon by bonding abrasive grains with a metal bond. Chamfering of the base periphery is advantageous in that even when the blade is over-ground in error beyond the border between the base and the abrasive layer during grinding for blade thickness adjustment purpose, the metal bond is left at the border to prevent the blade section from being separated apart. The angle and quantity of chamfer may be determined in accordance with the thickness of the base and the average grain size of abrasive grains because the range available for chamfering depends on the thickness of the base.

With respect to magnetic properties of the base, a greater saturation magnetization is preferred for holding abrasive grains to the base by magnetic attraction. Even if the base has a lower saturation magnetization, however, magnetic material-coated abrasive grains can be magnetically attracted toward the base by controlling the position of a permanent magnet and the strength of a magnetic field. For this reason, a base having a saturation magnetization of at least 40 kA/m (0.05 T) is satisfactory.

The saturation magnetization of a base is determined by cutting a sample of 5 mm squares out of a base having a given thickness, and measuring a magnetization curve ($4\pi I$-H) of the sample at a temperature of 24-25° C. by means of a vibrating sample magnetometer (VSM). The upper limit of magnetization values in the first quadrant is assigned as the saturation magnetization.

The abrasive grains used in the blade section are diamond grains and/or cubic boron nitride (cBN) grains. Depending on cutting operation conditions, abrasive grains having an average grain size of 45 to 310 μm are preferably used in the blade section. As used herein, the "average grain size" refers to a 50% diameter or median diameter as measured by a particle size distribution measuring system utilizing laser light diffraction and scattering. If the average grain size is less than 45 μm, there may be left smaller voids between abrasive grains, allowing problems like glazing and loading to occur during the cutting operation and losing the cutting ability. If the average grain size is more than 310 μm, problems may arise, for example, magnet pieces cut thereby may have rough surfaces. With the cutting efficiency and lifetime taken into account, abrasive grains of a certain size within the range may be used alone or as a mixture of grains of different sizes.

The abrasive grains used in the blade section should have a toughness index TI of at least 150. In an experiment, rare earth sintered magnet blocks were cut into pieces by outer blade cutting wheels in which the blade sections were formed by bonding diamond and cBN abrasive grains having an average grain size of 45 to 310 μm and different TI values. The magnet pieces cut therefrom were then determined for dimensions and tolerance. It was found that those cutting wheels using abrasive grains having a TI value of at least 150 could maintain a high cutting accuracy over a long term. The TI value is regarded as an index for practical evaluation of the durability of abrasive grains against impacts accompanied with heat generation.

The toughness index TI is determined by a friability test of placing one metal ball and a predetermined weight of abrasive grains in a cylindrical alloy container, sealing the container, shaking the container across a certain stroke at a predetermined frequency and room temperature (e.g., 15-25° C.), and determining the milling time (sec) passed until abrasive grains milled to a size below a certain level reach 50% of the initial weight (i.e., the overall weight of abrasive grains prior to the test).

Figure 5:
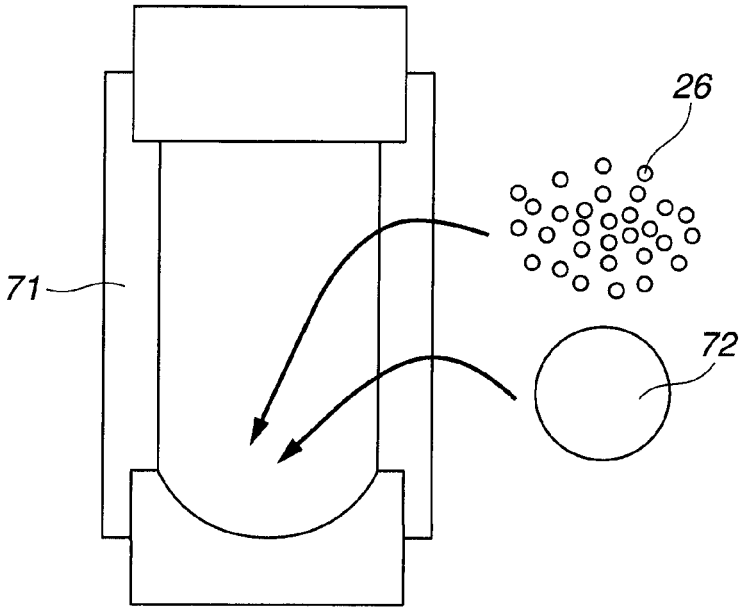
FIG. 5 schematically illustrates how to measure toughness index TI using an alloy container and a ball.

Specifically, the method pursuant to ANSI (American National Standards Institute) B74.23-2002 is applicable. As shown in FIG. 5, for example, an alloy container 71 defines a space delineated by a side wall having a diameter of 12.70±0.02 mm and a height of 19.10±0.01 mm, one end flat surface with a diameter of 12.70±0.02 mm, and another end semi-spherical surface with a radius of 7.14 mm and a depth of 3.84±0.06 mm. The container is charged with one ball 72 of chromium alloy steel having a diameter of 7.94±0.02 mm and a weight of 2.040±0.005 g, and a predetermined weight of abrasive grains 26 sieved through a predetermined mesh screen. The container is closed and shaken across a stroke of 8.1±1.5 mm at a frequency of 2,400±3 cycles/min and room temperature.

The alloy of which the container side wall is made is an alloy of the composition X100CrMoV51 (AISI Type A2) or an alloy having a Rockwell C (Rc) hardness 58 to 60. The alloy of which the flat surface and semi-spherical surface are made is an alloy of the composition X100Cr6 (AISI 52100) or an alloy having a Rc hardness 58 to 60.

To a sample of abrasive grains to be tested, the predetermined screen and sample amount listed in Table 1, that covers the range from 45 μm to 310 μm which corresponds to the average grain size of abrasive grains, are applied pursuant to the standard grain size of diamond or cBN abrasive grains. For example, reference is made to diamond abrasive grains having a standard grain size (US mesh size) of 80/100 (corresponding to FEPA (Federation of European Producers of Abrasives) grit size designation D/B 181). The abrasive grains are first sieved using an upper screen (screen A in Table 1) having a hole size of 197 μm and a lower screen (screen B in Table 1) having a hole size of 151 μm. Then 6 g of those abrasive grains remaining between the upper and lower screens are placed in the alloy container, which is shaken. The abrasive grains as milled are sieved through a post-breakdown screen having a hole size of 127 μm (screen C in Table 1). The milling time (in second) taken until the weight of undersize abrasive grains is 50% (i.e., 3 g) of the total weight (i.e., 6 g) of the initial abrasive grains is reported as toughness index (TI). As seen from Table 1, the screens and the weight of abrasive grains to be tested differ depending on the size of abrasive grains.

TABLE 1

| Standard grain size (mesh size) | FEPA grit designation | Sample weight (g) | Upper screen A | Lower screen B | Post-breakdown screen C |
|---|---|---|---|---|---|
| | | | Hole size (μm) | | |
| 50/60 | D/B 301 | 10 | 322 | 255 | 213 |
| 60/70 | D/B 251 | 10 | 271 | 213 | 181 |
| 70/80 | D/B 213 | 10 | 227 | 181 | 151 |
| 80/100 | D/B 181 | 6 | 197 | 151 | 127 |
| 100/120 | D/B 151 | 6 | 165 | 127 | 107 |
| 120/140 | D/B 126 | 6 | 139 | 107 | 90 |
| 140/170 | D/B 107 | 6 | 116 | 90 | 75 |
| 170/200 | D/B 91 | 6 | 97 | 75 | 65 |
| 200/230 | D/B 76 | 3 | 85 | 65 | 57 |
| 230/270 | D/B 64 | 3 | 75 | 57 | 49 |
| 270/325 | D/B 54 | 3 | 65 | 49 | 37 |
| 325/400 | D/B 46 | 3 | 57 | 41 | 32 |

A TI value of at least 150 indicates that abrasive grains are less friable, are little pulled out or worn so that a difference in wear (abrasion ratio) is maintained between abrasive grains and the metal bond, and further between abrasive grains and the metal, alloy or resin infiltrated into voids between abrasive grains and between abrasive grains and the base. Then high accuracy sawing can be maintained over a long term until abrasive grains are reduced to too small a size to retain. On the other hand, a TI value of less than 150 indicates that abrasive grains are friable and are readily pulled out and worn, achieving no interaction between abrasive grains and the metal bond and failing in high accuracy sawing.

Diamond is used as the abrasive grains. Diamond may be produced by the solubility difference method of converting graphite to diamond using a metal such as Fe, Ni, Co, Mn or Cr or an alloy thereof as the solvent, holding graphite in the co-presence of the metal or alloy and a catalyst, at diamond-stable pressure and temperature, or the temperature gradient method involving placing a carbon source at the hotter part and minute diamond seed crystal serving as the nucleus of growth at the cooler part, maintaining the temperature gradient between the carbon source and the seed crystal in a specific range via a metal solvent, applying high-temperature and high-pressure for causing diamond to grow on the seed crystal.

Cubic boron nitride (cBN) is also used as the abrasive grains. cBN may be produced by the method for conversion of hexagonal boron nitride (hBN) to cBN using a solution of an alkali metal such as Li, an element of Group 2 in the Periodic Table such as Mg or Ca, or a nitride or boride thereof as the catalyst, or the method involving placing hBN in a high-strength anvil, and applying high temperature and high pressure for converting the hBN to cBN.

In the abrasive grains thus produced, nitrogen which is contained in the reactor cell or solvent is entrained as the impurity. Effective means for minimizing the nitrogen content is to add a getter metal having high affinity to nitrogen such as Al, Ti or Zr to the solvent. However, a careful control is necessary in this case because these additives allow for introduction of carbide into diamond or become inhibitory to crystal growth to negatively affect impact resistance and heat resistance. The temperature difference method under high pressure is advantageously used to produce crystals with less impurities.

Depending on the production method and conditions, the abrasive grains thus produced vary in particle shape and have several crystal orientations giving different hardness or abrasion resistance.

For diamond, for example, [111] face is more susceptible to cracking and cleavage than [100] and [110] faces as found in the Hertz crush test. With respect to wear resistance, [110] face is susceptible to wear and [111] face is resistant to wear. It is then effective to produce abrasive grains having a relatively much grown face of specific orientation for a particular purpose by suitably adjusting the solvent metal, temperature and pressure, or to hold or bond abrasive grains in the matrix such that their relevant face may engage in effective cutting operation.

In a preferred embodiment, abrasive grains are coated with a magnetic material such that the coated abrasive grains may be magnetically attracted to a base of cemented carbide. Further, sputtering a metal such as Fe, Co or Cr onto surfaces of abrasive grains to a thickness of about 1 μm is effective for enhancing the bond strength to the magnetic material to be subsequently coated.

The magnetic material is typically at least one metal selected from Ni, Fe, and Co, an alloy of two or more such metals, or an alloy of one such metal or alloy with at least one metal selected from P and Mn. The abrasive grains are coated with a magnetic material by any well-known technique such as sputtering, electroplating or electroless plating until the thickness of the coating reaches 0.5 to 100%, preferably 2 to 80% of the diameter of abrasive grains.

The thickness of magnetic material coating should fall in an appropriate range because the coating thickness can affect the size of voids created between abrasive grains during formation of the blade section. The minimum thickness of coating is preferably at least 1.5 μm that is a thickness at which overall abrasive grains can be coated by plating, more preferably at least 2.5 μm. For example, for abrasive grains with an average grain size of 310 μm that is the maximum of the preferred average grain size range, the coating thickness may be at least 1.5 μm as long as it is at least 0.5% of the average grain size. The maximum thickness of coating is preferably up to 45 μm. For example, for abrasive grains with an average grain size of 45 μm that is the minimum of the preferred average grain size range, the coating thickness may be up to 100% of the average grain size because otherwise a fraction of abrasive grains which does not effectively functioning during cutting operation increases or which prevents self-sharpening of abrasive grains increases, degrading the machining capability. In this case, the coating thickness may be up to 45 μm as long as it is up to 100% of the average grain size.

As long as the coating of magnetic material has a thickness in the range, it offers a retaining force capable of reducing shedding of abrasive grains when the outer blade cutting wheel is used in cutting operation. As long as a magnetic material of proper type is selected for coating, abrasive grains are attracted and held to or near the outer periphery of the base by the magnetic field during the plating step, without falling off.

The metal bond is a metal or alloy deposited by plating. The metal bond used herein is at least one metal selected from the group consisting of Ni, Fe, Co, Cu, and Sn, an alloy consisting of at least two of the foregoing metals, or an alloy consisting of at least one of the foregoing metals or alloys and one or both of phosphorus (P) and manganese (Mn). The metal or alloy is deposited by plating so as to form interconnects between abrasive grains and between abrasive grains and the base.

The method of depositing the metal bond by plating is generally classified into two, an electroplating method and an electroless plating method. In the practice of the invention, the electroplating method which is easy to control internal stresses remaining in the metal bond and low in production cost and the electroless (or chemical) plating method which ensures relatively uniform deposition of metal bond as long as the plating solution penetrates there may be used alone or in combination so that the blade section may contain voids between abrasive grains in an appropriate range to be described later.

The stress in the plating film may be controlled by suitable means. For example, in single metal electroplating such as copper or nickel plating, typically nickel sulfamate plating, the stress may be controlled by selecting the concentration of the active ingredient or nickel sulfamate, the current density during plating, and the temperature of the plating bath in appropriate ranges, and adding an organic additive such as o-benzenesulfonimide or p-toluenesulfonamide, or an element such as Zn, S or Mn. Besides, in alloy plating such as Ni—Fe alloy, Ni—Mn alloy, Ni—P alloy, Ni—Co alloy or Ni—Sn alloy, the stress may be controlled by selecting the content of Fe, Mn, P, Co or Sn in the alloy, the temperature of the plating bath, and other parameters in appropriate ranges. In the case of alloy plating, addition of organic additives may, of course, be effective for stress control.

Plating may be carried out in a standard way by selecting any one of well-known plating baths for deposition of a single metal or alloy and using plating conditions common to that bath.

Examples of the preferred electroplating bath include a sulfamic acid Watts nickel electroplating bath containing 250 to 600 g/L of nickel sulfamate, 50 to 200 g/L of nickel sulfate, 5 to 70 g/L of nickel chloride, 20 to 40 g/L of boric acid, and an amount of o-benzenesulfonimide; and a pyrophosphoric acid copper electroplating bath containing 30 to 150 g/L of copper pyrophosphate, 100 to 450 g/L of potassium pyrophosphate, 1 to 20 mL/L of 25% ammonia water, and 5 to 20 g/L of potassium nitrate. A typical electroless plating bath is a nickel-phosphorus alloy electroless plating bath containing 10 to 50 g/L of nickel sulfate, 10 to 50 g/L of sodium hypophosphite, 10 to 30 g/L of sodium acetate, 5 to 30 g/L of sodium citrate, and an amount of thiourea.

When a blade section is formed by holding abrasive grains on the base via magnetic attraction, a permanent magnet must be disposed near the outer periphery of the base to produce a magnetic field. For example, two or more permanent magnets having a remanence (or residual magnetic flux density) of at least 0.3 T are disposed on the side surfaces of the base positioned inside the outer periphery thereof or within spaces disposed inside the outer periphery of the base and spaced a distance of not more than 20 mm from the side surfaces of the base, to thereby produce a magnetic field of at least 8 kA/m in a space extending a distance of 10 mm or less from the outer periphery of the base. The magnetic field acts on the diamond and/or cBN abrasive grains pre-coated with a magnetic material, to produce a magnetic attraction force. By this magnetic attraction force, the abrasive grains are magnetically attracted and fixedly held to or near the base outer periphery. With the abrasive grains held fixedly, electroplating or electroless plating of a metal or alloy is carried out on the base outer periphery for thereby bonding the abrasive grains to the base outer periphery.

The jig used in this process comprises a pair of holders each comprising a cover of insulating material having a greater outer diameter than the outer diameter of the base and a permanent magnet disposed on and fixedly secured to the cover inside the base outer periphery. Plating may be carried out while the base is held between the holders.

Figure 2:
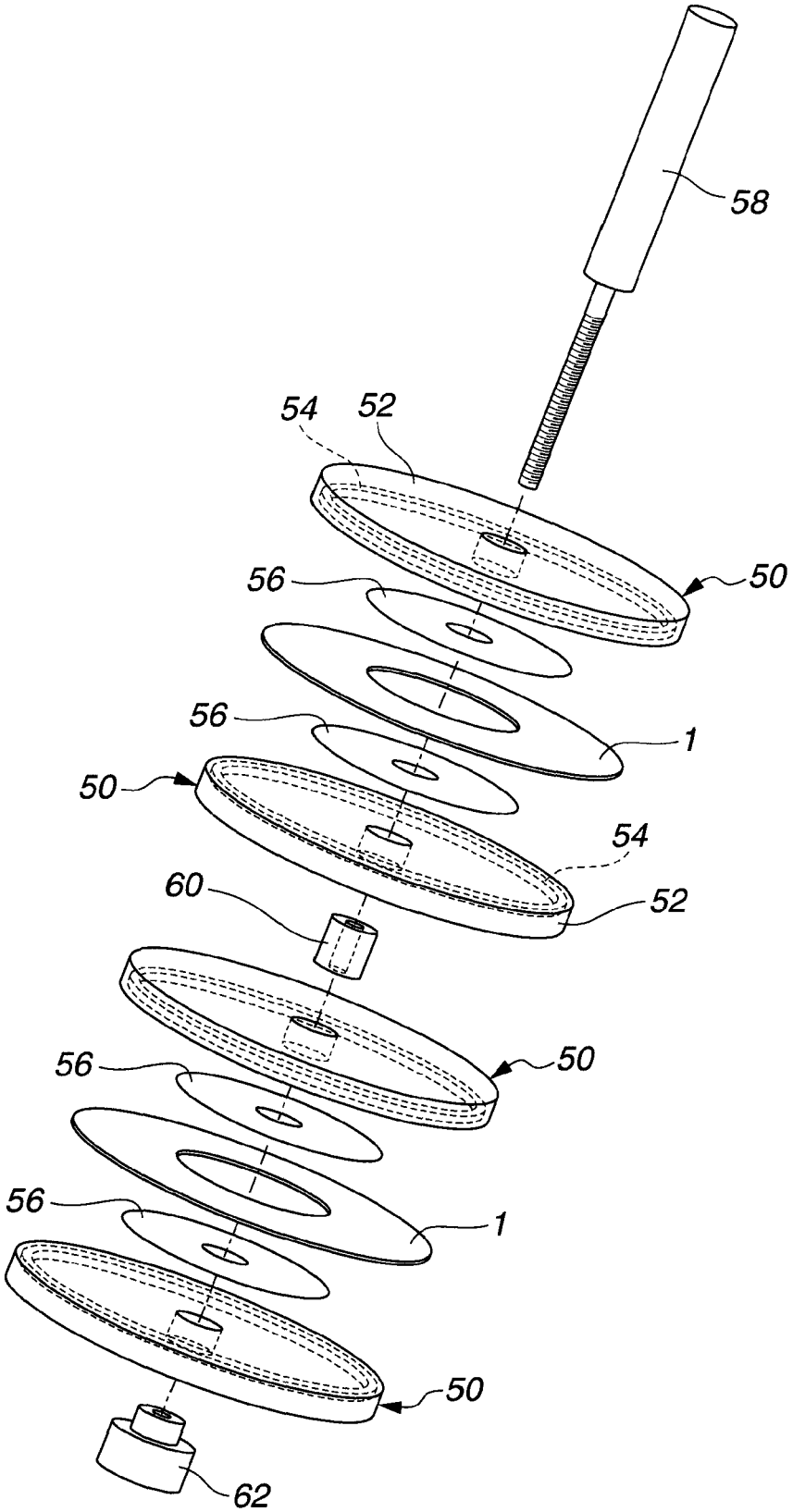
FIG. 2 is a perspective exploded view of one exemplary jig used in the method.
Figure 3:
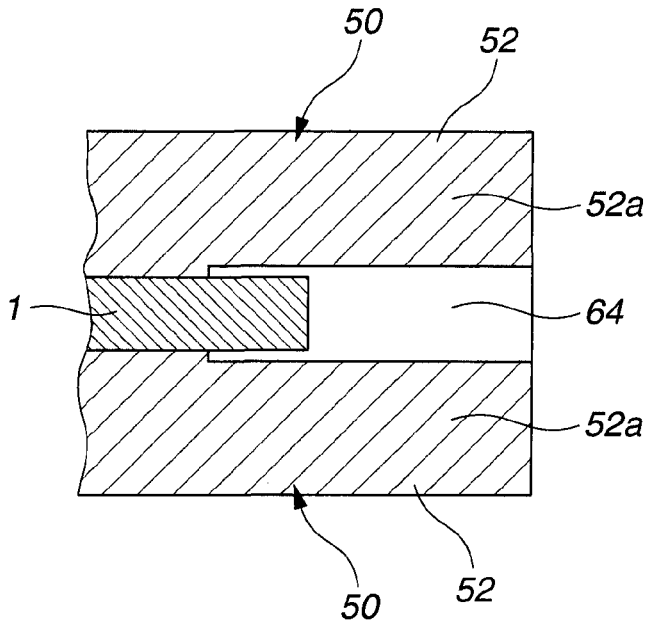
FIG. 3 is an enlarged cross-sectional view of the outer portions of the holders sandwiching the base in FIG. 2.

Referring to FIGS. 2 and 3, one exemplary jig for use in the plating process is shown. The jig comprises a pair of holders 50, 50 each comprising a cover 52 of insulating material and a permanent magnet 54 mounted on the cover 52. A base 1 is sandwiched between the holders 50 and 50. The permanent magnet 54 is preferably buried in the cover 52. Alternatively, the permanent magnet 54 is mounted on the cover 52 so that the magnet 54 may be in abutment with the base 1 when assembled.

The permanent magnet built in the jig should have a magnetic force sufficient to keep abrasive grains attracted to the base during the plating process of depositing a metal bond to bond abrasive grains. Although the necessary magnetic force depends on the distance between the base outer periphery and the magnet, and the magnetization of a magnetic material coated on abrasive grains, a desired magnetic force may be obtained from a permanent magnet having a remanence of at least 0.3 T and a coercivity of at least 0.2 MA/m.

The greater remanence a permanent magnet has, the greater gradient the magnetic field produced thereby has. Thus a permanent magnet with a greater remanence value is convenient when it is desired to locally attract abrasive grains. In this sense, use of a permanent magnet having a remanence of at least 0.3 T is preferred for preventing abrasive grains from separating apart from the base due to agitation of a plating solution and vibration by rocking motion of the base-holding jig during the plating process.

As the coercivity is greater, the magnet provides a stronger magnetic attraction of abrasive grains to the base for a long period even when exposed to a high-temperature plating solution. Then the freedom of choice with respect to the position, shape and size of a magnet used is increased, facilitating the manufacture of the jig. A magnet having a higher coercivity is selected from those magnets meeting the necessary remanence.

In view of potential contact of the magnet with plating solution, the permanent magnet is preferably coated so that the magnet may be more corrosion resistant. The coating material is selected under such conditions as to minimize the dissolution of the coating material in the plating solution and the substitution for metal species in the plating solution. In an embodiment wherein a metal bond is deposited from a nickel plating bath, the preferred coating material for the magnet is a metal such as Cu, Sn or Ni or a resin such as epoxy resin or acrylic resin.

The shape, size and number of permanent magnets built in the jig depend on the size of the cemented carbide base, and the position, direction and strength of the desired magnetic field. For example, when it is desired to uniformly bond abrasive grains to the base outer periphery, a magnet ring corresponding to the outer diameter of the base may be disposed, or arc shaped magnet segments corresponding to the outer diameter of the base or rectangular parallelepiped magnet segments having a side of several millimeters long may be continuously and closely arranged along the base outer periphery. For the purpose of reducing the cost of magnet, magnet segments may be spaced apart to reduce the number of magnet segments.

The spacing between magnet segments may be increased, though depending on the remanence of magnet segments used. With magnet segments spaced apart, magnetic material-coated abrasive grains are divided into one group of grains attracted and another group of grains not attracted. Then abrasive grains are alternately bonded to some areas, but not to other areas of the base outer periphery. A blade section consisting of spaced segments is formed.

With respect to the magnetic field produced near the base outer periphery, a variety of magnetic fields can be produced by changing a combination of the position and magnetization direction of permanent magnets mounted to two holders sandwiching the base. By repeating magnetic field analysis and experiments, the arrangement of magnets is determined so as to produce a magnetic field of at least 8 kA/m within a space extending a distance of 10 mm or less from the outer periphery of the base. When the strength of the magnetic field is less than 8 kA/m, it has a short magnetic force to attract magnetic material-coated abrasive grains, and if plating is carried out in this state, abrasive grains may be moved away during the plating process, and as a consequence, a blade section having many voids is formed, or abrasive grains are bonded in a dendritic way, resulting in a blade section having a size greater than the desired.

Subsequent dressing may cause the blade section to be separated apart or take a longer time. These concerns may increase the cost of manufacture.

Preferably the permanent magnet is placed nearer to the portion to which abrasive grains are attracted. Generally speaking, the permanent magnet is placed on the side surface of the base inside the outer periphery thereof or within a space situated inside the outer periphery of the base and extending a distance of not more than 20 mm from the side surface of the base and preferably within a space situated inside the outer periphery and extending a distance of not more than 10 mm from the side surface of the base. At least two permanent magnets having a remanence of at least 0.3 T (specifically at least one magnet per holder) are placed at specific positions within the spaces such that the magnets are entirely or partially situated within the spaces whereby a magnetic field having a strength of at least 8 kA/m can be produced within a space extending a distance of not more than 10 mm from the outer periphery of the base. Then, even though the base is made of a material having a low saturation magnetization and a less likelihood to induce a magnetic force such as cemented carbide, a magnetic field having an appropriate magnetic force can be produced near the outer periphery of the base. When magnetic material-coated abrasive grains are fed in the magnetic field, the coating is magnetized and consequently, the abrasive grains are attracted and held to or near the outer periphery of the base.

With respect to the position of the magnet relative to the outer periphery of the base, if the magnet is not placed within the space defined above, specifically if the magnet is placed outside the outer periphery of the base, though close thereto, for example, at a distance of 0.5 mm outward of the outer periphery of the base, then the magnetic field strength near the outer periphery of the base is high, but a region where the magnetic field gradient is reversed is likely to exist. Then abrasive grains tend to show a behavior of emerging upward from the base and shedding away. If the position of the magnet is inside the outer periphery of the base, but at a distance of more than 20 mm from the outer periphery of the base, then the magnetic field in the space extending a distance of not more than 10 mm from the outer periphery of the base tends to have a strength of less than 8 kA/m, with a risk of the force of magnetically attracting abrasive grains becoming short. In such a case, the strength of the magnetic field may be increased by enlarging the size of magnet. However, a large sized magnet is not so practical because the magnet-built-in jig also becomes large.

The shape of the jig (holders) conforms to the shape of the base. The size of the jig (holders) is such that when the base is sandwiched between holders, the permanent magnet in the holder may be at the desired position relative to the base. For a base having an outer diameter of 125 mm and a thickness of 0.26 mm and an array of permanent magnet segments of 2.5 mm long by 2 mm wide by 1.5 mm thick, for example, a disc having an outer diameter of at least 125 mm and a thickness of about 20 mm is used as the holder.

Specifically, the outer diameter of the jig or holder is selected to be equal to or greater than {the outer diameter of the base plus (height of blade section) multiplied by 2}, so as to ensure a height or radial protrusion (H2 in FIG. 1C) of the blade section, and the thickness of the jig or holder is selected so as to provide a strength sufficient to prevent warpage due to abrupt temperature changes by moving into and out of a hot plating bath. The thickness of the outer portion of the holder which comes in contact with abrasive grains may be reduced than the remaining portion so as to form an overlay portion (T3 by H1 in FIG. 1C) of the blade section which protrudes beyond the base in the thickness direction. If it is desired to increase the dimensional accuracy of the jig and to reduce the working cost, the thickness of the outer portion may be equal to that of the remaining portion if a masking tape or spacer having a thickness equal to the overlay portion is attached to that portion.

The material of which the jig or holders are made is preferably an insulating material on which no plating deposits, because the overall jig having the base sandwiched between the holders is immersed in a hot plating bath for depositing a metal bond on the base. More desirably the insulating material should have chemical resistance, heat resistance up to about 90° C., and thermal shock resistance sufficient to maintain the size constant even when exposed to repeated rapid thermal cycling in moving into and out of the plating bath. Also desirably the insulating material should have dimensional stability sufficient to prevent the holders from being warped by the internal stresses (accumulated during molding and working) to create a gap between the holder and the base when immersed in a hot plating bath. Of course, the insulating material should be so workable that a groove for receiving a permanent magnet at an arbitrary position may be machined at a high accuracy without fissures or chips.

Specifically, the holders may be made of engineering plastics such as PPS, PEEK, POM, PAR, PSF and PES and ceramics such as alumina. A holder is prepared by selecting a suitable material, determining a thickness and other dimensions in consideration of mechanical strength, molding the material to the dimensions, and machining a groove for receiving a permanent magnet and a recess for receiving an electric supply electrode which is necessary when electroplating is carried out. On use, a pair of such holders thus prepared is assembled so as to sandwich the base therebetween. When the holders are assembled together with an electrode for electric supply to the base to enable electroplating, this assembling procedure affords both electric supply and mechanical fastening and leads to a compact assembly as a whole. It is, of course, preferred that a plurality of jigs be connected as shown in FIG. 2 so that a plurality of bases may be plated at a time, because the production process becomes more efficient.

Specifically, as shown in FIG. 2, a cathode 56 which serves for electroplating and as a base retainer is fitted in a central recess in the cover 52. A jig is assembled by combining a pair of holders 50 with a base 1, inserting a conductive support shaft 58 into the bores of the holders and base, and fastening them together. In the assembled state, the cathodes 56 are in contact with the shaft 58, allowing for electric supply from the shaft 58 to the cathodes 56. In FIG. 2, two jigs each consisting of a pair of holders 50, 50 are mounted on the shaft 58 at a suitable spacing, using a spacer 60 and an end cap 62. Understandably the jig shown in FIG. 2 is intended for electroplating. In the case of electroless plating, the cathode is not necessary, a non-conductive retainer may be used instead, and the support shaft need not necessarily be conductive.

Using the jig, plating is carried out as follows. The jig is assembled by sandwiching the base 1 between the permanent magnet-built-in holders 50, 50. In this state, as shown in FIG. 3, a space 64 is defined by peripheral portions 52*a*, 52*a* (extending outward beyond the base) of covers 52, 52 of holders 50, 50 and the outer periphery of the base 1. A suitable amount of abrasive grains pre-coated with a magnetic material is weighed by a balance and fed into the space 64 where the abrasive grains are magnetically attracted and held. It is noted that when the outer periphery of the cemented carbide base is chamfered, the space 64 is set such that abrasive grains may enter between the chamfered portion and the jig holder. Absent sufficient abrasive grains in this region, the blade section resulting from plating may be held afloat in this region.

The amount of abrasive grains held in the space depends on the outer diameter and thickness of the base, the size of abrasive grains, and the desired height and width of the blade section to be formed. Also preferably the process of holding abrasive grains and effecting plating is repeated plural times so that the amount of abrasive grains per unit volume may be equalized at any positions on the base outer periphery and abrasive grains may be tenaciously bonded by the plating technique.

In this way, a blade section is formed. The blade section preferably contains abrasive grains in a volume fraction of 10 to 80% by volume, and more preferably 30 to 75% by volume. A fraction of less than 10% by volume means that less abrasive grains contribute to cutting, leading to increased resistance during the cutting operation. A fraction in excess of 80% by volume means that the deformation amount of cutting edge during the cutting operation is reduced, leaving cut marks on the cut surface and aggravating the dimensional accuracy and appearance of cut pieces. For these reasons, the cutting speed must be slowed down. It is thus preferred to adjust the volume fraction of abrasive grains for a particular application by changing the thickness of the magnetic material coating on abrasive grains to change the grain size.

Figure 1C:
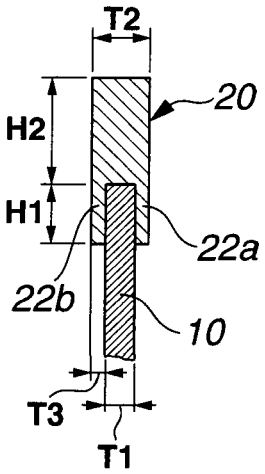

As shown in FIG. 1C, the blade section 20 consists of a pair of overlay portions (or clamp legs) 22*a*, 22*b* which clamp the outer rim of the base 10 therebetween in an axial direction and a body (20) which extends radially outward beyond the outer rim (periphery) of the base 10. It is noted that this division is for convenience of description because the clamp legs and the body are integral to form the blade section. The thickness of the blade section 20 (T2 in FIG. 1C) is greater than the thickness of the base 10 (T1 in FIG. 1C). To form the blade section of this design, the space 64 is preferably configured as shown in FIG. 3.

More specifically, the clamp legs 22*a*, 22*b* of the blade section 20 which clamp the outer rim of the base 10 therebetween each preferably have a length H1 of 0.1 to 10 mm, and more preferably 0.5 to 5 mm. The legs 22*a*, 22*b* each preferably have a thickness T3 of at least 5 μm (=0.005 mm), more preferably 5 to 2,000 μm, and even more preferably 10 to 1,000 μm. Then the total thickness of clamp legs 22*a*, 22*b* is preferably at least 0.01 mm, more preferably 0.01 to 4 mm, and even more preferably 0.02 to 2 mm. The blade section 20 is thicker than the base 10 by this total thickness. If the length H1 of clamp legs 22*a*, 22*b* is less than 0.1 mm, they are still effective for preventing the rim of the cemented carbide base from being chipped or cracked, but less effective for reinforcing the base and sometimes fail to prevent the base from being deformed by the cutting resistance. If the length H1 exceeds 10 mm, reinforcement of the base is made at the sacrifice of expense. If the thickness T3 of clamp leg is less than 5 μm, such thin legs may fail to enhance the mechanical strength of the base or to effectively discharge the swarf sludge.

Figures 4A, 4B, 4C, 4D:
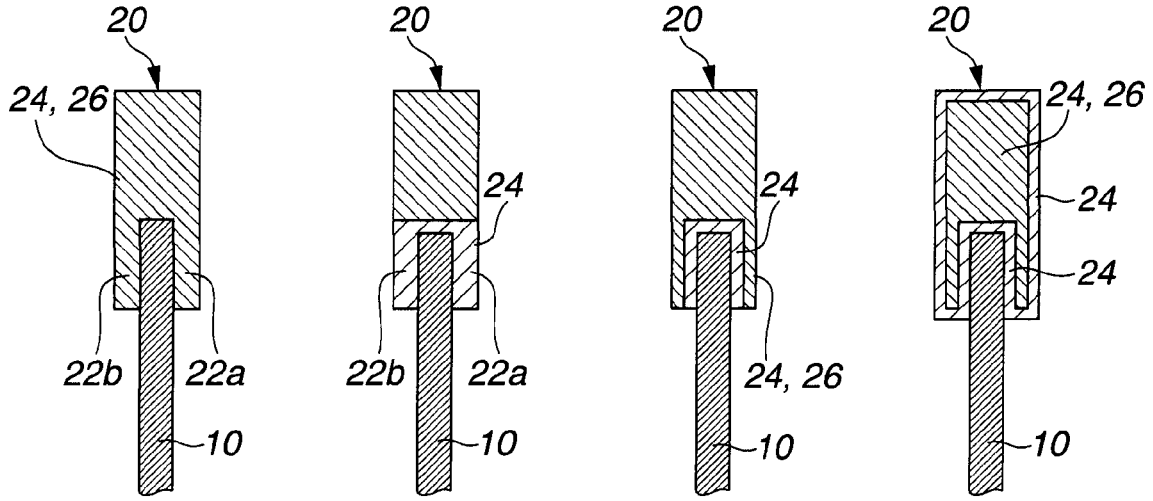
FIGS. 4A to 4D are cross-sectional views of different embodiments of the blade section formed on the base.

As shown in FIGS. 4A to 4D, the clamp legs 22*a*, 22*b* may consist of a metal bond 24 and abrasive grains 26 (FIG. 4A), consist of metal bond 24 (FIG. 4B), or include an underlying layer consisting of metal bond 24 covering the base 10 and an overlying layer consisting of metal bond 24 and abrasive grains 26 (FIG. 4C). Notably the strength of the blade section may be further increased by depositing a metal bond on the structure of FIG. 4C so as to surround the overall outer surface as shown in FIG. 4D.

In the embodiments shown in FIGS. 4B to 4D, the clamp leg inner portions in contact with the base 10 are formed solely of metal bond 24. To this end, the base is masked so that only the portions of the base on which the clamp legs are to be formed are exposed, and plating is carried out on the unmasked base portions. This may be followed by mounting the base in the jig, charging the space 64 with abrasive grains 26, and effecting plating. After the electroplating of abrasive grains, the base 10 may be masked with another pair of holders 50, 50 having a smaller outer diameter such that the electroplated portion is exposed, and plating is carried out again, forming a layer consisting of metal bond 24 as the blade section outermost layer as shown in FIG. 4D.

Referring back to FIG. 1C, the body of the blade section 20 which extends radially outward beyond the periphery of the base 10 has a length H2 which is preferably 0.1 to 10 mm, and more preferably 0.3 to 8 mm, though may vary with the size of abrasive grains bonded therein. If the body length H2 is less than 0.1 mm, the blade section may be consumed within a short time by impacts and wears during the cutting operation, which indicates a cutting wheel with a short lifetime. If the body length H2 exceeds 10 mm, the blade section may become susceptible to deformation, though dependent on the blade thickness (T2 in FIG. 1C), resulting in cut magnet pieces with wavy cut surfaces and hence, worsening dimensional accuracy.

By the plating method, abrasive grains which may be diamond abrasive grains and/or cBN abrasive grains are bonded together and to the outer periphery of the base to form at a high accuracy a blade section having dimensions approximate to the final shape.

In the outer blade cutting wheel having the blade section formed by bonding abrasive grains to the base by electroplating or electroless plating, since the abrasive grains used have a certain grain size, the abrasive grains as bonded are only in partial contact between abrasive grains and between abrasive grains and the base to leave voids there, which voids are not fully buried by plating. The blade section thus contains voids, i.e., pores in communication with the blade section surface even after plating.

As long as the load applied to the outer blade cutting wheel during cutting operation is low, high accuracy cutting is possible, even in the presence of such voids, because the blade section does not undergo substantial deformation by the force applied during cutting. However, where cutting is carried out under such a high load as to cause the cemented carbide base to be deformed, the blade edge can be in part deformed or shed. An effective method for preventing the blade edge from deformation or shedding is by enhancing the strength of the blade edge. However, the blade section should also have a sufficient elasticity to allow the blade section to flex to enable smooth mergence of cut surface segments.

In a further preferred embodiment, a metal and/or alloy binder having a melting point of up to 350° C. is infiltrated into the voids between abrasive grains and between abrasive grains and the base in the blade section. In a further preferred embodiment, a thermoplastic resin having a melting point of up to 350° C., preferably up to 300° C., and more preferably up to 250° C. is infiltrated into the voids or a liquid thermosetting resin composition having a curing temperature of up to 350° C., preferably up to 300° C., and more preferably up to 250° C. is infiltrated into the voids and cured there. Therefore, the outer blade cutting wheel in this embodiment is characterized in that a metal, alloy or resin is present between abrasive grains and between abrasive grains and the base throughout the blade section from the surface to the interior.

Suitable binders or infiltrants include metals such as Sn and Pb, and alloys such as S—Ag—Cu alloy, Sn—Ag alloy, Sn—Cu alloy, Sn—Zn alloy and Sn—Pb alloy, which may be used alone or as a mixture containing at least two of the foregoing.

The metal or alloy may be infiltrated into the blade section, for example, by working the metal or alloy into a wire with a diameter of 0.1 to 2.0 mm, preferably 0.8 to 1.5 mm, particles, or a thin-film ring of the same shape and size as the blade section having a thickness of 0.05 to 1.5 mm, resting the wire, particles or ring on the blade section, heating the blade section on a heater such as a hot plate or in an oven to a temperature above the melting point, holding the temperature for letting the melted metal or alloy infiltrate into the blade section, and thereafter slowly cooling to room temperature. Alternatively, infiltration is carried out by placing the outer blade cutting wheel in a lower mold half with a clearance near the blade section, charging the mold half with a weighed amount of metal or alloy, mating an upper mold half with the lower mold half, heating the mated mold while applying a certain pressure across the mold, for letting the melted metal or alloy infiltrate into the blade section. Thereafter the mold is cooled, the pressure is then released, and the wheel is taken out of the mold. The cooling step following heating should be slow so as to avoid any residual strains.

Before the metal or alloy is rested on the blade section, an agent for retaining the metal or alloy to the blade section or improving the wettability of the blade section, for example, a commercially available solder flux containing chlorine or fluorine may be applied to the blade section.

When a low-melting-point metal or alloy having relatively good wettability is used, infiltration may be carried out by sandwiching the base between metal members of stainless steel, iron or copper, conducting electricity to the metal members, causing the metal members to generate heat, thereby heating the base and the blade section, and bringing the heated blade section in contact with a molten low-melting-point metal.

Suitable infiltrating resins include thermoplastic resins and thermosetting resins, typically acrylic resins, epoxy resins, phenolic resins, polyamide resins, polyimide resins, and modified resins of the foregoing, which may be used alone or in admixture.

The thermoplastic or thermosetting resin may be infiltrated into the blade section, for example, by working the thermoplastic resin into a wire with a diameter of 0.1 to 2.0 mm, preferably 0.8 to 1.5 mm, particles, or a thin-film ring of the same shape and size as the blade section having a thickness of 0.05 to 1.5 mm, resting the wire, particles or ring on the blade section, heating the blade section on a heater such as a hot plate or in an oven to a temperature above the melting point, holding the temperature for letting the molten resin infiltrate into the blade section, and thereafter slowly cooling to room temperature. A thermosetting resin may be infiltrated by blending the resin with an organic solvent, a curing agent and the like to form a liquid thermosetting resin composition, casting the composition on the blade section, letting the composition infiltrate into the blade section, heating at or above the curing temperature, thereby curing, and thereafter slowly cooling to room temperature. Alternatively, infiltration is carried out by placing the outer blade cutting wheel in a lower mold half with a clearance near the blade section, charging the mold half with a weighed amount of the resin or resin composition, mating an upper mold half with the lower mold half, heating the mated mold while applying a certain pressure across the mold, for letting the resin or resin composition infiltrate into the blade section. Thereafter the mold is cooled, the pressure is then released, and the wheel is taken out of the mold. The cooling step following heating should be slow so as to avoid any residual strains.

When a resin having relatively good wettability is used, infiltration may be carried out by sandwiching the base between metal members of stainless steel, iron or copper, conducting electricity to the metal members, causing the metal members to generate heat, thereby heating the base and the blade section, and bringing the heated blade section in contact with a molten resin or liquid resin composition.

The metal, alloy or resin to be infiltrated into the blade section should preferably have the following physical properties. The melting point is preferably not higher than 350° C. In the case of resin, the melting point is not higher than 350° C., preferably not higher than 300° C., for the purpose of preventing the cemented carbide base from being distorted to aggravate dimensional accuracy or change mechanical strength, and preventing the blade section from deformation or strain generation due to an outstanding difference in thermal expansion between the cemented carbide base and the blade section. Typically a resin having a melting point of not higher than 250° C. is employed. In the case of thermosetting resin, the melting temperature is preferably at least 10° C. because it suffices that a thermosetting resin composition has a sufficient fluidity to infiltrate at room temperature.

The metal, alloy or resin may have a hardness which is not so high as to prevent self-sharpening of abrasive grains (a phenomenon that new abrasive grains emerge, contributing to the cutting operation) when abrasive grains are worn, broken or shed during the cutting operation, and which is lower than that of the metal bond for bonding the abrasive grains and the magnetic material coating thereon. Also preferably, the metal, alloy or resin should not undergo strength changes or corrosion even when exposed to the machining fluid or coolant used during the machining process.

In the resulting blade section, the abrasive grains, the magnetic material covering abrasive grains, the metal bond, and the metal, alloy or resin infiltrated into voids are properly dispersed.

As described above, the blade section includes overlay portions which each protrude axially outward beyond the thickness of the base. The blade section is shaped to ensure that the thickness (T3 in FIG. 1C) of the overlay portion of the blade section has a tolerance [($T3_{max}$−$T3_{min}$) mm] in the range (1):

$$0.001 \le T3_{max} - T3_{min} \le 0.133\ T2_{max} \quad (1)$$

wherein $T3_{max}$ and $T3_{min}$ maximum and minimum values of the thickness (T3 in FIG. 1C) of the overlay portion throughout the circumference of the blade section, $T2_{max}$ is a maximum value of the thickness (T2 in FIG. 1C) of the blade section throughout the circumference of the blade section. The distance over which the blade section axially protrudes beyond the thickness of the base corresponds to the thickness of clamp legs (24 in FIG. 4) flanking the base and is depicted at thickness T3 in FIG. 1C. Since this thickness is on both front and back sides of the base, the blade section is shaped so as to meet the tolerance range on each side.

The blade section is also shaped to ensure that the blade section has a roundness [($OD_{max}/2$−$OD_{min}/2$) mm] in the range (2):

$$0.001 \le OD_{max}/2 - OD_{min}/2 \le 0.01 \times OD_{max} \quad (2)$$

wherein $OD_{max}$ and $OD_{min}$ are maximum and minimum values of the outer diameter of the blade section.

Now that the blade section is shaped so as to meet the dimensional ranges defined above, the cutting wheel can be used to saw magnet blocks into pieces over a long term while maintaining the pieces at an acceptable dimensional tolerance or a high accuracy. The blade section may be trued typically by grinding with a grinding wheel based on aluminum oxide, silicon carbide or diamond, or by electric discharge machining, so as to meet the dimensional ranges.

In the trueing step, the blade section at the edge may be chamfered (beveled or rounded) to a degree of at least C0.1 or R0.1, though depending on the thickness of the blade section, because such chamfering is effective for reducing cut marks on the cut surface or mitigating chipping of magnet pieces. Where the blade section is chamfered, it suffices that the thickness tolerance of the blade section overlay portion and the roundness of the blade section excluding the chamfered portion meet the dimensional ranges defined herein.

To maintain the accuracy of cutting operation high, the tolerance and roundness are preferably controlled to ranges as narrow as possible. Since abrasive grains having a high toughness index TI are used, the blade section itself has high durability, suggesting quite difficult trueing of the blade section itself and outstanding costs for trueing. To reduce the trueing cost and eventually, the price of the outer blade cutting wheel, a provision must be made so as to minimize the trueing step.

When magnet blocks are sawed into pieces by the outer blade cutting wheel in which abrasive grains having a toughness index TI of at least 150 are used, the thickness of the overlay portion of the blade section has a tolerance of up to ($0.1 \times T2_{max}$) mm, and the blade section has a roundness of up to ($0.01 \times OD_{max}$) mm, the dimensional tolerance of magnet pieces cut out thereby can be maintained at a high cutting accuracy over a long term. Even when abrasive grains having high durability and difficulty of trueing and typically a toughness index TI of at least 150 are used, the trueing of the blade section which enables high accuracy cutting can be performed more conveniently than in the prior art. Then the manufacture cost of the outer blade cutting wheel itself can be reduced.

If the thickness of the overlay portion has a tolerance of more than ($0.1 \times T2_{max}$) mm, the blade section is outstandingly wavy relative to the base. If the blade section has a roundness of more than ($0.01 \times OD_{max}$) mm, the blade section discontinuously contacts with the workpiece, which induces, in the case of high-speed rotation, substantial vibration during cutting operation, causing chipping of the workpiece, and in an extreme case, breakage of the workpiece. On the other hand, if the thickness of the overlay portion has a tolerance of less than 0.001 mm, or if the blade section has a roundness of less than 0.001 mm, abrasive grains are less exposed, leading to a lower cutting efficiency, and the gap between the blade section and the workpiece is reduced, providing a short supply of coolant to the cutting site and hence, insufficient cooling, exacerbating the cutting accuracy. These deficiencies vary depending on the cutting conditions, and the radial protrusion (or height) and axial protrusion (or thickness) of the blade section, and in the worst case, seizure occurs between the blade section and the workpiece. Reducing the tolerance and roundness to a lower level than the necessity not only increases the working cost of the outer blade cutting wheel, but also reduces the dimensional accuracy of pieces and causes troubles during cutting operation. For the reason mentioned above, the thickness of the overlay portion preferably has a tolerance of at least 0.001 mm and up to ($0.1 \times T2_{max}$) mm, more preferably at least 0.005 mm and up to ($0.05 \times T2_{max}$) mm. Also, the blade section preferably has a roundness of at least 0.001 mm and up to ($0.01 \times OD_{max}$) mm, more preferably at least 0.005 mm and up to ($0.005 \times OD_{max}$) mm.

Figure 6A:
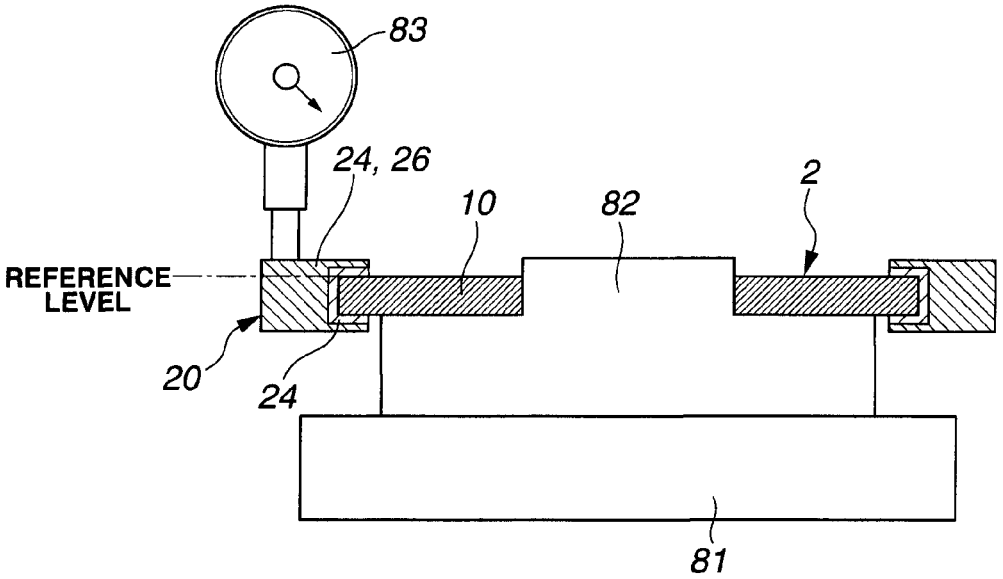
FIG. 6 schematically illustrates how to measure the tolerance of the thickness of the overlay portion of the blade section, FIG. 6A being a schematic view of the measuring system, and FIG. 6B being a view of the comparator having a probe in contact with the blade section.
Figure 6B:
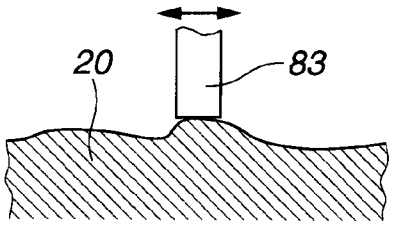

The thickness of the overlay portion of the blade section may be measured, for example, as shown by the schematic view of FIG. 6. As shown in FIG. 6A, a jig 82 having a smaller outer diameter than the outer diameter of the blade section 20 is rested on a rotatable platform 81. The outer blade cutting wheel 2 is rested on the jig 82. The thickness of the overlay portion of the blade section 20 is measured by a comparator 83 using the height of the side surface of the base 10 as reference. The blade section 20 shown in FIG. 6 corresponds to the blade section 20 of the embodiment shown in FIG. 4C as comprising metal bond 24 and abrasive grains 26. As shown in FIG. 6B, while the probe of the comparator 83 is kept in contact with the surface of the blade section 20, the surface is scanned with the comparator. Then waves on the surface of the blade section 20 are measured as topographical or height data. Although it is desired that the jig have a higher flatness, the influence of flatness can be avoided by the offset technique of subtracting the pre-measured flatness from the measurement. In the case of a thin base, the measurement procedure must be carefully controlled such that the load applied by the comparator during measurement may not become excessive, because the outer blade is otherwise deflected to invite a change of the apparent height when the base or blade section is pushed by the comparator.

Figure 7A:
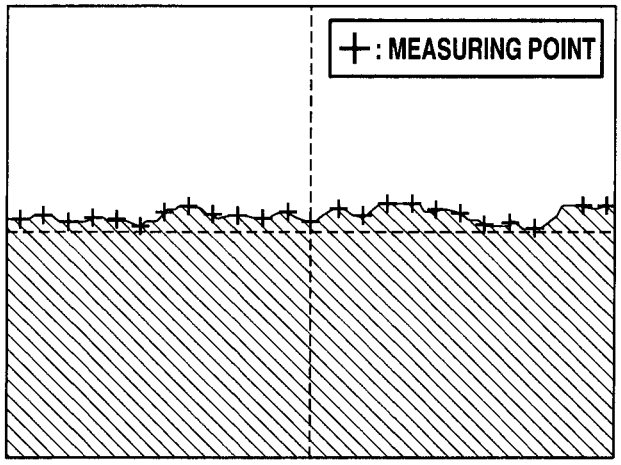
FIG. 7 schematically illustrates how to measure the roundness of the blade section, FIG. 7A being an exemplary projection image of the blade section and FIG. 7B illustrating the calculation of the roundness using the image.
Figure 7B:
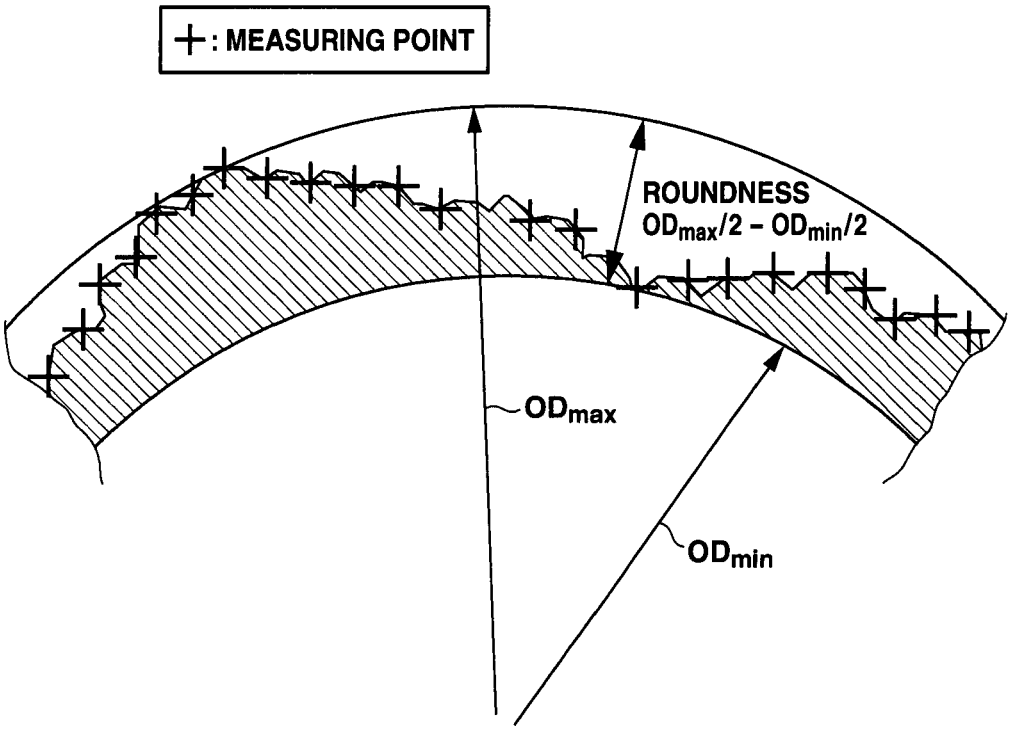

The roundness of the blade section may be measured, for example, by the following procedure. A jig having a smaller outer diameter than the outer diameter of the blade section 20 is rested on a glass table. The outer blade cutting wheel is rested on the jig. Light is irradiated from below the glass table to project an image as shown in FIG. 7A. From this image, positions on the outer diameter of the shade of the blade section are taken as coordinate data. From these coordinates, as seen from the schematic view of FIG. 7B, according to the minimum zone center (MZC) method of JIS B-0621, the difference between ½ of the maximum ($OD_{max}$) and ½ of the minimum ($OD_{min}$) of the outer diameter of the blade section 20 when the difference in radius of two concentric circles circumscribing an image drawn by connecting measurement points becomes the smallest is computed. Such a non-contact measuring instrument of analyzing bright and dark information data for measurement is very useful because even irregularities including exposed abrasive grains can be measured.

On use of the outer blade cutting wheel of the invention, various workpieces may be cut thereby. Typical workpieces include R—Co rare earth sintered magnets and R—Fe—B rare earth sintered magnets wherein R is at least one of rare earth elements inclusive of yttrium. These magnets are prepared as follows.

R—Co rare earth sintered magnets include $RCo_5$ and $R_2Co_{17}$ systems. Of these, the $R_2Co_{17}$ magnets have a composition (in % by weight) comprising 20-28% R, 5-30% Fe, 3-10% Cu, 1-5% Zr, and the balance of Co. They are prepared by weighing source materials in such a formulation, melting them, casting the melt, and finely pulverizing the alloy to an average particle size of 1-20 μm, yielding a $R_2Co_{17}$ magnet powder. The powder is then compacted in a magnetic field and sintered at 1,100-1,250° C. for 0.5-5 hours. The sintered body is subjected to solution treatment at a temperature lower than the sintering temperature by 0-50° C. for 0.5-5 hours, and aging treatment of holding at 700-950° C. for a certain time and subsequent cooling.

R—Fe—B rare earth sintered magnets have a composition (in % by weight) comprising 5-40% R, 50-90% Fe, and 0.2-8% B. An additive element or elements may be added thereto for improving magnetic properties and corrosion resistance, the additive elements being selected from C, Al, Si, Ti, V, Cr, Mn, Co, Ni, Cu, Zn, Ga, Zr, Nb, Mo, Ag, Sn, Hf, Ta, W, etc. The amount of additive element is up to 30% by weight for Co, and up to 8% by weight for the other elements. The magnets are prepared by weighing source materials in such a formulation, melting them, casting the melt, and finely pulverizing the alloy to an average particle size of 1-20 μm, yielding a R—Fe-B magnet powder. The powder is then compacted in a magnetic field and sintered at 1,000-1,200° C. for 0.5-5 hours, followed by aging treatment of holding at 400-1,000° C. for a certain time and subsequent cooling.

EXAMPLE

Examples are given below by way of illustration and not by way of limitation.

Example 1

A cemented carbide consisting of 90 wt % WC and 10 wt % Co was machined into an annular thin disc having an outer diameter of 125 mm, an inner diameter of 40 mm, and a thickness of 0.3 mm, which served as a base. The base had a Young's modulus of 600 GPa and a saturation magnetization of 127 kA/m (0.16 T).

The cemented carbide base was sandwiched between polyphenylene sulfide (PPS) resin discs having an outer diameter of 123 mm and a thickness of 10 mm so that only a circumferential region of either base surface extending 1.0 mm inward from the outer periphery was exposed. The base was immersed in a commercially available aqueous alkaline solution at 40° C. for 10 minutes for degreasing, washed with water, and immersed in an aqueous solution of 30-80 g/L of sodium pyrophosphate at 50° C. where electrolysis was effected at a current density of 2-8 A/dm$^2$. The base was ultrasonic washed in deionized water and immersed in a sulfamic acid Watts nickel plating bath at 50° C. where an undercoat was plated at a current density of 5-20 A/dm$^2$. Thereafter, the base was washed with water.

A PPS disc having an outer diameter of 130 mm and a thickness of 10 mm was machined on one side surface to form a groove having an outer diameter of 123 mm, an inner diameter of 119 mm, and a depth of 1.5 mm. In the groove of the disc, 75 permanent magnet segments of 2.5 mm long by 2 mm wide by 1.5 mm thick (N39UH by Shin-Etsu Rare Earth Magnets Co., Ltd., Br=1.25 T) were arranged at an equal spacing, with the thickness direction of the segment aligned with the depth direction of the groove. The groove was filled with an epoxy resin to fixedly secure the magnet segments in the groove, completing a magnet-built-in holder. The base was sandwiched between a pair of such holders to construct a jig, with the magnet sides of the holders faced inside. In the sandwiched state, the magnet was spaced inward a distance of 1 mm from the base outer periphery along the base surface. The magnet produced a magnetic field near the base outer periphery, which was analyzed to have a strength of at least 8 kA/m (0.01 T) within a space extending a distance of 10 mm from the base outer periphery.

Diamond abrasive grains having an average grain size of 103 μm (standard grain size 140/170) and TI of 500 were previously NiP-plated to form coated diamond abrasive grains. In a recess defined by the holders and the base, 0.4 g of the coated diamond abrasive grains were fed whereby the abrasive grains were magnetically attracted to and uniformly distributed over the entire base outer periphery. The jig with the abrasive grains attracted thereto was immersed in a sulfamic acid Watts nickel plating bath at 50° C. where electroplating was effected at a current density of 5-20 A/dm$^2$. The jig was taken out and washed with water. The procedure of magnetically attracting 0.4 g of coated diamond abrasive grains, electroplating, and water washing was repeated.

The holders of the jig were replaced by PPS resin disc holders having an outer diameter of 123 mm and a thickness of 10 mm. The base was sandwiched between the holders so that the side surfaces of the abrasive grain layer (blade section) were exposed. The jig was immersed in a sulfamic acid Watts nickel plating bath at 50° C. where electricity was conducted at a current density of 5-20 A/dm$^2$ to deposit a plating over the entire blade section. The jig was taken out and washed with water, after which the base was dismounted and dried, obtaining an outer blade cutting wheel.

Using a surface grinding machine, the wheel was ground to tailor the overlay portion or thickness of the blade section such that the blade section protruded a distance (T3) of 50 μm beyond the cemented carbide base on each surface. The outer diameter was tailored by wire electro-discharge machining (wire-EDM). The wheel was dressed, yielding a cemented carbide base outer blade cutting wheel including a blade section having an overlay portion design thickness of 0.05 mm, $T2_{max}$ of 0.43 mm, an overlay portion thickness tolerance of 0.02 mm, chamfer C0.1, a design outer diameter of 127 mm, $OD_{max}$ of 127.3 mm, and a roundness of 0.6 mm.

Example 2

A cemented carbide consisting of 90 wt % WC and 10 wt % Co was machined into an annular thin disc having an outer diameter of 125 mm, an inner diameter of 40 mm, and a thickness of 0.3 mm, which served as a base.

The cemented carbide base was sandwiched between PPS discs having an outer diameter of 123 mm and a thickness of 10 mm so that only a circumferential region of either base surface extending 1.0 mm inward from the outer periphery was exposed. The base was immersed in a commercially available aqueous alkaline solution at 40° C. for 10 minutes for degreasing, washed with water, and immersed in an aqueous solution of 30-80 g/L of sodium pyrophosphate at 50° C. where electrolysis was effected at a current density of 2-8 A/dm$^2$. The base was ultrasonic washed in deionized water and immersed in a sulfamic acid Watts nickel plating bath at 50° C. where an undercoat was plated at a current density of 5-20 A/dm$^2$. Thereafter, the base was washed with water.

A ceramic disc having an outer diameter of 130 mm and a thickness of 10 mm was machined on one side surface to form a groove having an outer diameter of 123 mm, an inner diameter of 119 mm, and a depth of 1.5 mm. In the groove of the disc, 75 permanent magnet segments of 2.5 mm long by 2 mm wide by 1.5 mm thick (N39UH by Shin-Etsu Rare Earth Magnets Co., Ltd., Br=1.25 T) were arranged at an equal spacing, with the thickness direction of the segment aligned with the depth direction of the groove. The groove was filled with an epoxy resin to fixedly secure the magnet segments in the groove, completing a magnet-built-in holder. The base was sandwiched between a pair of such holders to construct a jig, with the magnet sides of the holders faced inside. In the sandwiched state, the magnet was spaced inward a distance of 1 mm from the base outer periphery along the base surface. The magnet produced a magnetic field near the base outer periphery, which was analyzed to have a strength of at least 8 kA/m (0.01 T) within a space extending a distance of 10 mm from the base outer periphery.

Diamond abrasive grains having an average grain size of 103 μm (standard grain size 140/170) and TI of 1,000 were previously NiP-plated to form coated diamond abrasive grains. In a recess defined by the holders and the base, 0.4 g of the coated diamond abrasive grains were fed whereby the abrasive grains were magnetically attracted to and uniformly distributed over the entire base outer periphery. The jig with the abrasive grains attracted thereto was immersed in a sulfamic acid Watts nickel plating bath at 50° C. where electroplating was effected at a current density of 5-20 A/dm$^2$. The jig was taken out and washed with water. The procedure of magnetically attracting 0.4 g of coated diamond abrasive grains, electroplating, and water washing was repeated.

The holders of the jig were replaced by PPS resin disc holders having an outer diameter of 123 mm and a thickness of 10 mm. The base was sandwiched between the holders so that the side surfaces of the abrasive grain layer were exposed. The jig was immersed in a sulfamic acid Watts nickel plating bath at 50° C. where electricity was conducted at a current density of 5-20 A/dm$^2$ to deposit a plating over the entire blade section. The jig was taken out and washed with water, after which the base was dismounted and dried, obtaining an outer blade cutting wheel.

A wire of 1.0 mm diameter was made of Sn-3Ag-0.5Cu alloy (m.p. 220° C.). A ring of the wire was rested on the side surface of the blade section of the outer blade cutting wheel, which was placed in an oven. The oven was heated up to 200° C., and after confirming an internal temperature reaching 200° C., further heated up to 250° C., held at 250° C. for about 5 minutes, and then turned off. The wheel was allowed to cool down in the oven.

Using a surface grinding machine, the wheel was ground to tailor the overlay portion or thickness of the blade section such that the blade section protruded a distance (T3) of 50 μm beyond the cemented carbide base on each surface. The outer diameter was tailored by wire electro-discharge machining (wire-EDM). The wheel was dressed, yielding a cemented carbide base outer blade cutting wheel including a blade section having an overlay portion design thickness of 0.05 mm, $T2_{max}$, of 0.41 mm, an overlay portion thickness tolerance of 0.018 mm, chamfer C0.2, a design outer diameter of 127 mm, $OD_{max}$ of 127.1 mm, and a roundness of 0.7 mm.

Example 3

A cemented carbide consisting of 90 wt % WC and 10 wt % Co was machined into an annular thin disc having an outer diameter of 125 mm, an inner diameter of 40 mm, and a thickness of 0.3 mm, which served as a base.

The cemented carbide base was sandwiched between PPS discs having an outer diameter of 123 mm and a thickness of 10 mm so that only a circumferential region of either base surface extending 1.0 mm inward from the outer periphery was exposed. The base was immersed in a commercially available aqueous alkaline solution at 40° C. for 10 minutes for degreasing, washed with water, and immersed in an aqueous solution of 30-80 g/L of sodium pyrophosphate at 50° C. where electrolysis was effected at a current density of 2-8 A/dm$^2$. The base was ultrasonic washed in deionized water and immersed in a sulfamic acid Watts nickel plating bath at 50° C. where an undercoat was plated at a current density of 5-20 A/dm$^2$. Thereafter, the base was washed with water.

cBN abrasive grains having an average grain size of 86 μm (standard grain size 170/200) and TI of 160 were previously NiP-plated to form coated cBN abrasive grains. After the base was sandwiched between the holders of the jig as in Example 1, 0.4 g of the coated cBN abrasive grains were fed in a recess defined by the holders and the base, whereby the abrasive grains were magnetically attracted to and uniformly distributed over the entire base outer periphery. The jig with the abrasive grains attracted thereto was immersed in a sulfamic acid Watts nickel plating bath at 50° C. where electroplating was effected at a current density of 5-20 A/dm$^2$. The jig was taken out and washed with water. The procedure of magnetically attracting 0.4 g of coated cBN abrasive grains, electroplating, and water washing was repeated.

The holders of the jig were replaced by PPS resin disc holders having an outer diameter of 123 mm and a thickness of 10 mm. The base was sandwiched between the holders so that the side surfaces of the abrasive grain layer were exposed. The jig was immersed in a sulfamic acid Watts nickel plating bath at 50° C. where electricity was conducted at a current density of 5-20 A/dm$^2$ to deposit a plating over the entire blade section. The jig was taken out and washed with water, after which the base was dismounted and dried, obtaining an outer blade cutting wheel.

A liquid epoxy resin composition obtained by dissolving bisphenol A diglycidyl ether and dicyandiamide as main resin-forming components in an organic solvent was coated onto the side surface of the blade section of the outer blade cutting wheel and held for 3 minutes. The wheel was placed in an oven at 180° C. where it was held for about 120 minutes. The oven was turned off whereupon the wheel was allowed to cool down in the oven.

Using a surface grinding machine, the wheel was ground to tailor the overlay portion or thickness of the blade section such that the blade section protruded a distance (T3) of 50 μm beyond the cemented carbide base on each surface. The outer diameter was tailored by wire electro-discharge machining (wire-EDM). The wheel was dressed, yielding a cemented carbide base outer blade cutting wheel including a blade section having an overlay portion design thickness of 0.05 mm, $T2_{max}$ of 0.405 mm, an overlay portion thickness tolerance of 0.01 mm, chamfer C0.1, a design outer diameter of 127 mm, $OD_{max}$ of 127.05 mm, and a roundness of 0.4 mm.

Example 4

A cemented carbide consisting of 95 wt % WC and 5 wt % Co was machined into an annular thin disc having an outer diameter of 125 mm, an inner diameter of 40 mm, and a thickness of 0.3 mm, which served as a base. The base had a Young's modulus of 580 GPa and a saturation magnetization of 40 kA/m (0.05 T).

The cemented carbide base was sandwiched between PPS discs having an outer diameter of 123 mm and a thickness of 10 mm so that only a circumferential region of either base surface extending 1.0 mm inward from the outer periphery was exposed. The base was immersed in a commercially available aqueous alkaline solution at 40° C. for 10 minutes for degreasing, washed with water, and immersed in an aqueous solution of 30-80 g/L of sodium pyrophosphate at 50° C. where electrolysis was effected at a current density of 2-8 $A/dm^2$. The base was ultrasonic washed in deionized water and immersed in a sulfamic acid Watts nickel plating bath at 50° C. where an undercoat was plated at a current density of 5-20 $A/dm^2$. Thereafter, the base was washed with water.

Diamond abrasive grains having an average grain size of 86 μm (standard grain size 170/200) and TI of 250 were previously NiP-plated to form coated diamond abrasive grains. After the base was sandwiched between the holders of the jig as in Example 1, 0.3 g of the coated diamond abrasive grains were fed in a recess defined by the holders and the base, whereby the abrasive grains were magnetically attracted to and uniformly distributed over the entire base outer periphery. The jig with the abrasive grains attracted thereto was immersed in an electroless nickel-phosphorus alloy plating bath at 80° C. where electroless plating was effected. The jig was taken out and washed with water. The procedure of magnetically attracting 0.3 g of coated diamond abrasive grains, electroless plating, and water washing was repeated twice. The wheel was dismounted from the jig and dried.

A wire of 1.0 mm diameter was made of Sn-3Ag-0.5Cu alloy (m.p. 220° C.). A ring of the wire was rested on the side surface of the blade section of the outer blade cutting wheel, which was placed in an oven. The oven was heated up to 200° C., and after confirming an internal temperature reaching 200° C., further heated up to 250° C., held at 250° C. for about 5 minutes, and then turned off. The wheel was allowed to cool down in the oven.

Using a surface grinding machine, the wheel was ground to tailor the overlap portion or thickness of the blade section such that the blade section protruded a distance (T3) of 50 μm beyond the cemented carbide base on each surface. The outer diameter was tailored by wire electro-discharge machining (wire-EDM). The wheel was dressed, yielding a cemented carbide base outer blade cutting wheel including a blade section having an overlap portion design thickness of 0.05 mm, $T2_{max}$ of 0.398 mm, an overlap portion thickness tolerance of 0.02 mm, chamfer of C0.1, a design outer diameter of 127 mm, $OD_{max}$ of 127.1 mm, and a roundness of 0.5 mm.

Comparative Example 1

A cemented carbide consisting of 90 wt % WC and 10 wt % Co was machined into an annular thin disc having an outer diameter of 125 mm, an inner diameter of 40 mm, and a thickness of 0.3 mm, which served as a base.

The cemented carbide base was sandwiched between PPS discs having an outer diameter of 123 mm and a thickness of 10 mm so that only a circumferential region of either base surface extending 1.0 mm inward from the outer periphery was exposed. The base was immersed in a commercially available aqueous alkaline solution at 40° C. for 10 minutes for degreasing, washed with water, and immersed in an aqueous solution of 30-80 g/L of sodium pyrophosphate at 50° C. where electrolysis was effected at a current density of 2-8 $A/dm^2$. The base was ultrasonic washed in deionized water and immersed in a sulfamic acid Watts nickel plating bath at 50° C. where an undercoat was plated at a current density of 5-20 $A/dm^2$. Thereafter, the base was washed with water.

Diamond abrasive grains having an average grain size of 103 μm (standard grain size 140/170) and TI of 200 were previously NiP-plated to form coated diamond abrasive grains. After the base was sandwiched between the holders of the jig as in Example 1, 0.4 g of the coated diamond abrasive grains were fed in a recess defined by the holders and the base, whereby the abrasive grains were magnetically attracted to and uniformly distributed over the entire base outer periphery. The jig with the abrasive grains attracted thereto was immersed in a sulfamic acid Watts nickel plating bath at 50° C. where electroplating was effected at a current density of 5-20 $A/dm^2$. The jig was taken out and washed with water. The procedure of magnetically attracting 0.4 g of coated diamond abrasive grains, electroplating, and water washing was repeated.

The holders of the jig were replaced by PPS resin disc holders having an outer diameter of 123 mm and a thickness of 10 mm. The base was sandwiched between the holders so that the side surfaces of the abrasive grain layer were exposed. The jig was immersed in a sulfamic acid Watts nickel plating bath at 50° C. where electricity was conducted at a current density of 5-20 $A/dm^2$ to deposit a plating over the entire blade section. The jig was taken out and washed with water, after which the base was dismounted and dried, obtaining an outer blade cutting wheel.

A wire of 1.0 mm diameter was made of Sn-3Ag-0.5Cu alloy (m.p. 220° C.). A ring of the wire was rested on the side surface of the blade section of the outer blade cutting wheel, which was placed in an oven. The oven was heated up to 200° C., and after confirming an internal temperature reaching 200° C., further heated up to 250° C., held at 250° C. for about 5 minutes, and then turned off. The wheel was allowed to cool down in the oven.

Using a surface grinding machine, the wheel was ground to tailor the overlay portion or thickness of the blade section such that the blade section protruded a distance (T3) of 50 μm beyond the cemented carbide base on each surface. The outer diameter was tailored by wire electro-discharge machining (wire-EDM). The wheel was dressed, yielding a cemented carbide base outer blade cutting wheel including a blade section having an overlay portion design thickness of 0.05 mm, $T2_{max}$ of 0.41 mm, an overlay portion thickness tolerance of 0.044 mm, a design outer diameter of 127 mm, $OD_{max}$ of 127.1 mm, and a roundness of 1.29 mm.

Comparative Example 2

A cemented carbide consisting of 90 wt % WC and 10 wt % Co was machined into an annular thin disc having an outer diameter of 125 mm, an inner diameter of 40 mm, and a thickness of 0.3 mm, which served as a base.

The cemented carbide base was sandwiched between PPS discs having an outer diameter of 123 mm and a thickness of 10 mm so that only a circumferential region of either base surface extending 1.0 mm inward from the outer periphery was exposed. The base was immersed in a commercially available aqueous alkaline solution at 40° C. for 10 minutes for degreasing, washed with water, and immersed in an aqueous solution of 30-80 g/L of sodium pyrophosphate at 50° C. where electrolysis was effected at a current density of 2-8 A/dm$^2$. The base was ultrasonic washed in deionized water and immersed in a sulfamic acid Watts nickel plating bath at 50° C. where an undercoat was plated at a current density of 5-20 A/dm$^2$. Thereafter, the base was washed with water.

cBN abrasive grains having an average grain size of 103 μm (standard grain size 140/170) and TI of 140 were previously NiP-plated to form coated cBN abrasive grains. After the base was sandwiched between the holders of the jig as in Example 1, 0.4 g of the coated cBN abrasive grains were fed in a recess defined by the holders and the base, whereby the abrasive grains were magnetically attracted to and uniformly distributed over the entire base outer periphery. The jig with the abrasive grains attracted thereto was immersed in a sulfamic acid Watts nickel plating bath at 50° C. where electroplating was effected at a current density of 5-20 A/dm$^2$. The jig was taken out and washed with water. The procedure of magnetically attracting 0.4 g of coated cBN abrasive grains, electroplating, and water washing was repeated.

The holders of the jig were replaced by PPS resin disc holders having an outer diameter of 123 mm and a thickness of 10 mm. The base was sandwiched between the holders so that the side surfaces of the abrasive grain layer were exposed. The jig was immersed in a sulfamic acid Watts nickel plating bath at 50° C. where electricity was conducted at a current density of 5-20 A/dm$^2$ to deposit a plating over the entire blade section. The jig was taken out and washed with water, after which the base was dismounted and dried, obtaining an outer blade cutting wheel.

A wire of 1.0 mm diameter was made of Sn-3Ag-0.5Cu alloy (m.p. 220° C.). A ring of the wire was rested on the side surface of the blade section of the outer blade cutting wheel, which was placed in an oven. The oven was heated up to 200° C., and after confirming an internal temperature reaching 200° C., further heated up to 250° C., held at 250° C. for about 5 minutes, and then turned off. The wheel was allowed to cool down in the oven.

Using a surface grinding machine, the wheel was ground to tailor the overlay portion or thickness of the blade section such that the blade section protruded a distance (T3) of 50 μm beyond the cemented carbide base on each surface. The outer diameter was tailored by wire electro-discharge machining (wire-EDM). The wheel was dressed, yielding a cemented carbide base outer blade cutting wheel including a blade section having an overlay portion design thickness of 0.05 mm, $T2_{max}$ of 0.42 mm, an overlay portion thickness tolerance of 0.048 mm, a design outer diameter of 127 mm, $OD_{max}$ of 127.2 mm, and a roundness of 1.32 mm.

Figure 8:
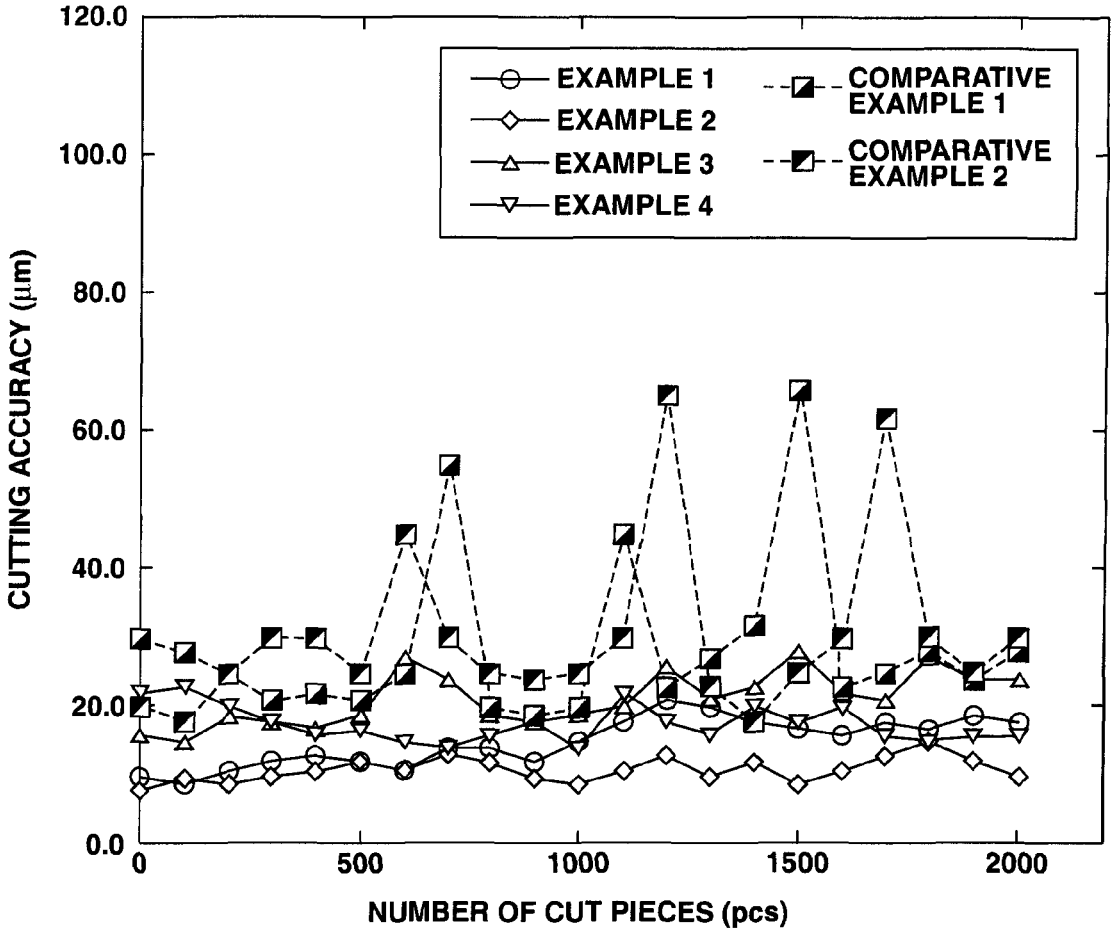
FIG. 8 is a diagram showing the cutting accuracy versus the number of pieces which are cut from a rare earth sintered magnet block using the outer blade cutting wheels of Examples 1 to 4 and Comparative Examples 1, 2.

Using the cemented carbide base outer blade cutting wheel, a rare earth sintered magnet block was sawed into magnet pieces. The sawing accuracy of magnet pieces is plotted in the diagram of FIG. 8.

The sawing accuracy was evaluated by providing outer blade cutting wheels of Examples 1 to 4 and Comparative Examples 1 and 2, two wheels for each Example, with a total of 12 wheels. A multiple wheel assembly was constructed by arranging twelve cutting wheels at a spacing of 1.0 mm, inserting a rotating shaft into the bores in the bases, and fastening them together. By operating the multiple wheel assembly at 4,500 rpm and a feed speed of 35 mm/min, a Nd—Fe—B rare earth sintered magnet block of 40 mm wide by 120 mm long by 20 mm high was sawed into magnet pieces of 40 mm wide by 1.0 mm long (=thickness (t)) by 20 mm high. The sawing operation was repeated until the number of cut magnet pieces totaled to 2,005 for a pair of cutting wheels of the same Example. Of these, the magnet pieces cut between a pair of cutting wheels of the same Example were selected for examination. Every size measuring cycle included from #1 to #100 pieces, indicating total twenty cycles. Early five pieces in each cycle are sampled out (i.e., #1 to #5 from the first cycle, #101 to #105 from the second cycle, and so forth, and #2,001 to #2,005 from the last cycle). It is noted that in the test, when the cutting accuracy exceeded 50 μm, indicative of an unacceptable accuracy, only the corresponding wheels were dressed again.

For five pieces in each cycle, the thickness (t) of each piece was measured at the center and four corners (five points in total) by a micrometer. A difference between maximum and minimum among five measurements is the cutting accuracy (μm). An average value of the cutting accuracies of five pieces was computed. This average value of every size measuring cycle is plotted in the diagram of FIG. 8.

In Comparative Examples 1 and 2, the cutting accuracy worsened after seven size measuring cycles (from #601 cut magnet piece et seq.) and re-dressing was necessary to resume an acceptable cutting accuracy. In Examples 1 to 4, no dressing was needed, despite some variations, until the twentieth cycle (until #2,005 cut magnet piece), and a satisfactory cutting accuracy was maintained over a long term without a drop.

It is demonstrated that the outer blade cutting wheels of the invention are capable of machining workpieces, typically rare earth sintered magnet blocks at a high size accuracy over a long term.

Japanese Patent Application No. 2011-148045 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. An outer blade cutting wheel comprising a base in the form of an annular thin disc of cemented carbide having a Young's modulus of 450 to 700 GPa, having an outer diameter of 80 to 200 mm defining an outer periphery, an inner diameter of 30 to 80 mm, and a thickness of 0.1 to 1.0 mm, and a blade section disposed on the outer periphery of the base and having a greater thickness than the base, said blade section comprising abrasive grains and a metal or alloy bond, the metal or alloy bond being deposited on the outer periphery of the base by electroplating or electroless plating for bonding abrasive grains together and to the base, wherein said abrasive grains are diamond and/or cBN abrasive grains having an average grain size of 45 to 310 μm and a toughness index TI of at least 150, said blade section includes overlay portions which each protrude outward beyond the thickness of said base, the thickness of the overlay portion of said blade section has a tolerance [($T3_{max}$−$T3_{min}$) mm] in the range (1):

$$0.001 \leq T3_{max} - T3_{min} \leq 0.1 \times T2_{max} \quad (1)$$

wherein $T3_{max}$ and $T3_{min}$ are maximum and minimum values of the thickness of the overlay portion throughout the circumference of the blade section, $T2_{max}$ is a maximum value of the thickness of the blade section throughout the circumference of the blade section, and said blade section has a roundness [($OD_{max}/2 - OD_{min}/2$) mm] in the range (2):

$$0.001 \leq OD_{max}/2 - OD_{min}/2 \leq 0.01 \times OD_{max} \quad (2)$$

wherein $OD_{max}$ and $OD_{min}$ are maximum and minimum values of the outer diameter of the blade section.

2. The cutting wheel of claim 1 wherein said blade section further comprises a metal or alloy binder having a melting point of up to 350° C. and after the metal or alloy bond is deposited on the outer periphery of the base by plating for bonding abrasive grains together and to the base, the metal or alloy binder is infiltrated between abrasive grains and between abrasive grains and the base.

3. The cutting wheel of claim 1 wherein said blade section further comprises a thermoplastic resin having a melting point of up to 350° C. or a thermosetting resin having a curing temperature of up to 350° C. and after the metal or alloy bond is deposited on the outer periphery of the base by plating for bonding abrasive grains together and to the base, the thermoplastic resin is infiltrated between abrasive grains and between abrasive grains and the base, or a liquid thermosetting resin composition is infiltrated and cured between abrasive grains and between abrasive grains and the base.

4. A method for manufacturing an outer blade cutting wheel comprising the steps of:

providing a base in the form of an annular thin disc of cemented carbide having a Young's modulus of 450 to 700 GPa, having an outer diameter of 80 to 200 mm defining an outer periphery, an inner diameter of 30 to 80 mm, and a thickness of 0.1 to 1.0 mm, providing abrasive grains, and electroplating or electroless plating a metal or alloy on the base outer periphery for bonding the abrasive grains together and to the base to fixedly secure the abrasive grains to the base outer periphery to form a blade section having a greater thickness than the base, said method further comprising the steps of:

using diamond and/or cBN abrasive grains having an average grain size of 45 to 310 μm and a toughness index TI of at least 150 as said abrasive grains, and shaping said blade section such that said blade section includes overlay portions which each protrude outward beyond the thickness of said base, the thickness of the overlay portion of said blade section has a tolerance [($T3_{max}$−$T3_{min}$) mm] in the range (1):

$$0.001 \leq T3_{max} - T3_{min} \leq 0.1 \times T2 \quad (1)$$

wherein $T3_{max}$ and $T3_{min}$ maximum and minimum values of the thickness of the overlay portion throughout the circumference of the blade section, $T2_{max}$ is a maximum value of the thickness of the blade section throughout the circumference of the blade section, and said blade section has a roundness [($OD_{max}/2 - OD_{min}/2$) mm] in the range (2):

$$0.001 \leq OD_{max}/2 - OD_{min}/2 \leq 0.01 \times OD_{max} \quad (2)$$

wherein $OD_{max}$ and $OD_{min}$ are maximum and minimum values of the outer diameter of the blade section.

5. The method of claim 4, further comprising, after the step of plating a metal or alloy on the outer periphery of the base for bonding abrasive grains together and to the base, the step of letting a metal or alloy binder having a melting point of up to 350° C. infiltrate into any voids between abrasive grains and between abrasive grains and the base to form the blade section.

6. The method of claim 4, further comprising, after the step of plating a metal or alloy on the outer periphery of the base for bonding abrasive grains together and to the base, the step of letting a thermoplastic resin having a melting point of up to 350° C. infiltrate into any voids between abrasive grains and between abrasive grains and the base to form the blade section, or a liquid thermosetting resin composition having a curing temperature of up to 350° C. infiltrate and cure into any voids between abrasive grains and between abrasive grains and the base to form the blade section.

* * * * *